US007571752B1

(12) United States Patent
Donohoe

(10) Patent No.: US 7,571,752 B1
(45) Date of Patent: Aug. 11, 2009

(54) SECURITY WALLET INSERT FOR THWARTING LOSS OF CREDIT CARDS

(75) Inventor: David G. Donohoe, P.O. Box 1165, Springville, CA (US) 93265

(73) Assignees: Joseph Kudla, Harleysville, PA (US); David G. Donohoe, Springville, CA (US)

( * ) Notice: Subject to any disclaimer, the term of this patent is extended or adjusted under 35 U.S.C. 154(b) by 434 days.

(21) Appl. No.: 11/332,574

(22) Filed: Jan. 13, 2006

Related U.S. Application Data

(60) Provisional application No. 60/691,485, filed on Jun. 20, 2005.

(51) Int. Cl.
*A45C 1/06* (2006.01)

(52) U.S. Cl. ..... 150/134; 150/147

(58) Field of Classification Search ..... 150/134, 150/147–149, 133; 206/39
See application file for complete search history.

(56) References Cited

U.S. PATENT DOCUMENTS

| | | | | | |
|---|---|---|---|---|---|
| 284,737 | A * | 9/1883 | Heysinger | 206/39 |
| 1,059,187 | A * | 4/1913 | McKee | 206/39.6 |
| 1,463,619 | A * | 7/1923 | Gardner | 206/39.4 |
| 1,585,051 | A * | 5/1926 | Skoglund | 206/39.4 |
| 1,658,496 | A * | 2/1928 | Qvarnstrom | 206/39 |
| 1,791,703 | A * | 2/1931 | Benedict et al. | 150/147 |
| 3,244,211 | A * | 4/1966 | Byers et al. | 150/147 |
| D222,203 | S * | 10/1971 | Hudson | D3/253 |
| 5,052,328 | A * | 10/1991 | Eppenbach | 116/200 |
| 5,878,874 | A * | 3/1999 | Weggelaar | 206/39.1 |
| 5,881,788 | A * | 3/1999 | Hersh et al. | 150/116 |
| 6,026,873 | A * | 2/2000 | Van Geer | 150/147 |
| 6,648,038 | B2 * | 11/2003 | Vetter | 150/147 |
| 2005/0279435 | A1 * | 12/2005 | Coates | 150/147 |

FOREIGN PATENT DOCUMENTS

| | | | |
|---|---|---|---|
| FR | 2636509 A1 | * | 3/1990 |
| WO | WO 91/01096 | * | 2/1991 |

* cited by examiner

*Primary Examiner*—Sue A Weaver
(74) *Attorney, Agent, or Firm*—William L. Chapin

(57) ABSTRACT

A security wallet insert for thwarting loss of credit cards includes a carrying case which is installed in a foldable wallet, the insert having pockets for holding individual credit cards, and a movable member which must be extended relative to the insert to allow a card to be removed from a pocket, the extended movable member uncovering a "replace credit card" message and making it difficult to close the wallet and thereby impractical to return it to a pocket or purse. A spring activated by removal of a card from a pocket prevents the extended movable member from being returned to a closed non-obstructing position unless the spring is depressed, thus providing a positive reminder that a credit card must be returned to the wallet after the user has made a transaction, and thereby minimizing the probability that the card will be inadvertently left at a place of use.

13 Claims, 13 Drawing Sheets

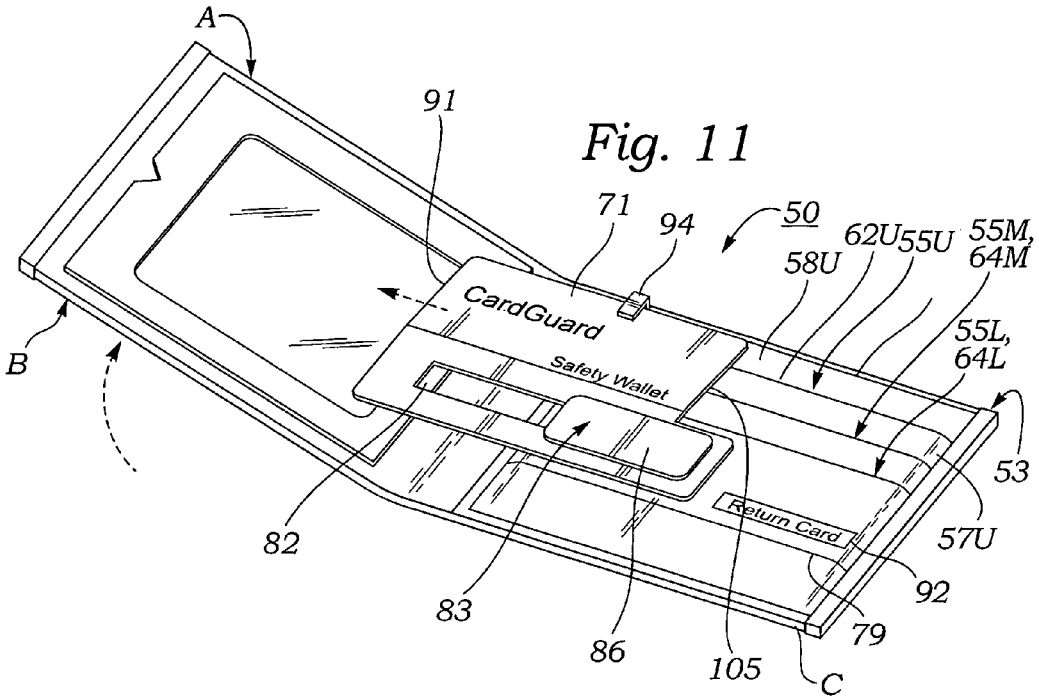
Fig. 11
Fig. 12B
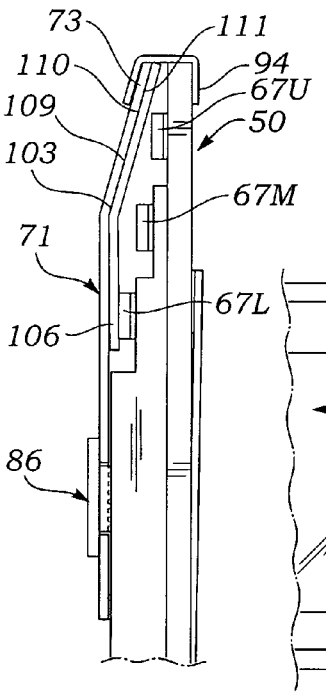
Fig. 12A
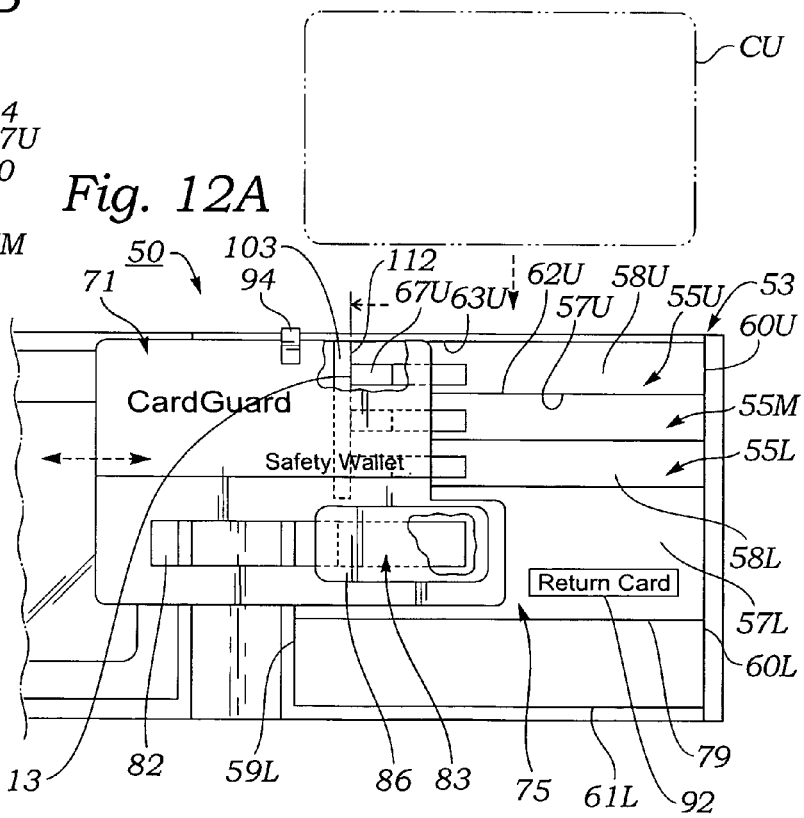

SECURITY WALLET INSERT FOR THWARTING LOSS OF CREDIT CARDS

This application claims priority to U.S. Provisional Patent Application No. 60/691,485, filled Jun. 6, 2005.

BACKGROUND OF THE INVENTION

A. Field of the Invention

The present invention relates to articles useable by a person to carry his or her credit cards. More particularly, the invention relates to a carrying case for a plurality of credit cards, which is useable separately or as an insert installed in a wallet, the construction of the case preventing it from being conveniently closed and returned to a person's pocket or purse until and unless a credit card which has been removed from the insert for use in a transaction has been returned to the insert.

B. Description of Background Art

Losing a credit card by accidently leaving it behind after use at a place of business is a very common occurrence. Reported credit card losses resulting from such oversights are staggering. Loss of a credit card can become a virtual nightmare, for a number of reasons. For example, trying to remember where one has last used his or her credit card, the inconvenience of returning to a business establishment to determine if the card has been left there, and the haunting fear of wondering whether the card is still there are common experiences associated with a credit card loss. Moreover, if the credit card is not present at a presumed location, problems for the credit card holder can quickly escalate. These problems include the hassle and time involved in reporting the credit card missing and obtaining a replacement card. An even worse problem being faced increasingly today is not merely the financial losses resulting from charges made on a card by someone who has stolen or found the card, since such losses are generally limited by statute to relatively small sums, but the much more substantial losses which can result from identify theft facilitated by a thief's use of a lost credit card. The financial and psychological costs of such identify theft can be truly devastating.

For the foregoing reasons, it can be readily understood that the loss of a person's credit card is a serious matter, warranting substantial efforts to discourage such a loss. Accordingly, a number of prior art devices have been disclosed which are intended to minimize loss of credit cards.

Prior art disclosures of devices for discouraging credit card loss include Beck et al., U.S. Pat. No. 4,719,453, Card Carrier Having An Alarm, which includes a credit card holder that has a battery, an audible/visible alarm such as a beeper and/or flashing light, and an electronic sensor which energizes the alarm upon removal of a credit card. Potential disadvantages of the device include high production costs, requirement for batteries which could fail at inopportune times. Moreover, beeping sounds and slashing lights could be annoying to other patrons of a business establishment, and do not insure that the wallet will not be folded closed and put away before the card is returned. Also, electronic systems in general are failure-prone.

Eppenbach, U.S. Pat. No. 5,052,328, Apparatus For Preventing Credit Card Loss, discloses a wallet which includes an elongated rectangular leaf spring that is compressed by insertion of a credit card into a pocket over the leaf spring, and which elastically expands into a triangular cross-section band when the card is removed, the apex of the triangle abutting the opposing side of a center-fold wallet if an attempt is made to fold the wallet closed without replacing the credit card. However, because the overall protrusion height of the expanded leaf spring is inherently limited to a relatively small value, the wallet can still be folded closed with little noticeable effort. Thus, although the spring does hold open to some degree the center-fold area of the wallet when the wallet is folded closed, the protruding spring is not a sufficient deterrent to prevent the wallet from being closed and replaced into purse, handbag or large pocket.

Galante, U.S. Pat. No. 5,125,356, Missing Card Warning Device discloses a warning device for insertion into a credit card pocket of a wallet, the warning device consisting of a planar sheet which has protruding from one or more edges thereof a resilient rectangular strip which is resiliently raised upwards form the sheet to indicate removal of a credit card from a location overlying the device. The device offers no deterrence to inadvertently folding the wallet closed and pulling it away before the card is returned. The protruding strips offer a e reminder and would probably tend to go unnoticed by a person experiencing the many distractions customarily associated with the use of a credit card.

Vetter, U.S. Pat. No. 6,648,038, Wallet Card Reminder, discloses a wallet which has credit card pockets, each having a front wall with a top edge and a rear wall that extends higher than the front wall top edge. A holographic-type light-reflecting strip is attached to the rear wall to lie above the tope edge of the front wall, providing a visual reminder to a user when a credit card is removed from the pocket. However, experience indicates that in most cases, such visual warnings will go unnoticed. Once any type of printed reminder or warning is viewed on a regular basis over an extended period of time, the reminder loses its effect and is eventually ignored. Credit cards are lost because people are not paying attention in the first place, and therefore, it stands to reason that in time they will not pay attention to the warning feature this invention discloses.

The present invention was conceived of to provide an effective device for thwarting loss of credit cards.

OBJECTS OF THE INVENTION

An object of the present invention is to provide a portable carrying case for credit cards which is constructed in a manner that thwarts loss of credit cards.

Another object of the invention is to provide a credit card carrying case which is configured as a wallet insert that has a movable member which must be extended from an orientation which blocks access to a compartment for holding a credit card, to enable the card to be removed from the compartment, the extended movable member making it difficult to replace the wallet in a pocket or purse.

Another object of the invention is to provide a wallet insert for carrying credit cards which may be carried by itself or inserted into a wallet, the wallet insert including a movable member that must be extended from a credit card pocket compartment section of the wallet insert to enable access to and removal of one or more credit cards held within a plurality of pockets in the compartment section, the extending movable member increasing a maximum outline dimension of the wallet insert to the extent that the wallet insert cannot be conveniently replaced in a person's pocket or purse, or, if the wallet insert is installed in a folding wallet, the wallet in which the insert is installed cannot be folded closed to enable replacement of the wallet in a pocket or purse.

Another object of the invention is to provide a wallet insert for carrying credit cards which includes an obstructing member that must be extended from a credit card pocket compartment section of the wallet insert to enable access to and removal of one or more credit cards held within a plurality of individual pockets in the compartment section, the extended obstructing member increasing a maximum dimension of the insert of the wallet insert to the extent that the wallet insert cannot be conveniently replaced in a person's pocket or purse, and, when the wallet insert is installed in a folding wallet, preventing the wallet from being folded close, the insert including a locking mechanism for preventing the extended obstructing member from being retracted to a non-extending, non-obstructing orientation unless all credit cards are reinserted into the pockets.

Another object of the invention is to provide a wallet insert which includes an obstructing member comprising a blocking arm that must be extended from a credit card compartment section of the wallet insert, to enable a cover panel which overlies credit cards held within a plurality of individual pockets in the compartment section to be moved away from the pockets to thereby enable access to and removal of one or more credit cards from the pockets, the extended obstructing member increasing a maximum dimension of the wallet insert to the extent that it cannot be replaced in a person's pocket or purse, or, when the insert is installed in a folding wallet, preventing the wallet from being folded close, unless the blocking arm is retracted.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a portable carrying case for credit cards which comprises a wallet insert that is useable by itself or as a component of a wallet. A wallet insert for thwarting loss of credit cards according to the present invention includes a credit card compartment section which has a plurality, e.g., three, of individual rectangularly-shaped credit compartments, each of suitable size and shape to hold a standard credit card.

According to the invention, the wallet insert includes a moveable cover panel which overlies credit cards inserted into pockets of the credit compartment section. The cover panel must be translationally or pivotably moved, i.e., slid or pivoted, to uncover the credit card compartments and thereby enable credit cards to be removed from their respective pockets, and returned to the pockets upon completion of a transaction using the credit card. In one embodiment of the invention, the translated or pivoted credit card compartment cover panel extends outwardly from the credit card compartment, thus increasing the maximum outline dimension of the wallet insert by an amount sufficiently appreciable to make the wallet insert difficult if not impossible to return to a pocket or small purse, unless the cover panel is restored to a position covering the credit card compartment pockets. A "Return Card" reminder message printed on the insert compartment and displayed when the cover panel is moved to an uncovering position reminds a user of the wallet insert to return any credit cards removed from the credit card compartment pockets before sliding or rotating the cover panel to its closed position. When the wallet insert is installed in a folding wallet, the outwardly extended cover panel prevents the wallet from being closed.

In another embodiment of the invention, the wallet insert has a blocking arm which must be moved to an extended, obstructing position to enable a cover panel over the credit card pockets from being pivoted downwards from a closed position which allows access to credit cards in the pockets.

In a preferred embodiment of a wallet insert for thwarting loss of credit cards according to the present invention, the wallet insert includes a locking mechanism for locking the cover panel in its open, outwardly extended, obstructing position, unless each credit card pocket contains a credit card, thus ensuring that all credit cards must be returned to the compartment before the cover panel of the wallet insert can be closed, thereby elevating the status of the "RETURN CARD" notice from a reminder to a mandate.

A preferred, locking embodiment of a credit card wallet insert according to the present invention includes a credit compartment which has a cover panel that is slidably mounted to the compartment, enabling the cover panel to be slid from a compact, closed position covering credit card pockets of the compartment, to an open position allowing access to credit cards in the compartment, in which the panel is slid laterally outwardly from the compartment to thus increase its width by a substantial amount, i.e., greater than fifty percent. In this embodiment, each credit card compartment pocket is provided with a resilient locking tab, such as a spring steel strip, which protrudes forward from a rear wall of the pocket. The locking tab is depressed to a relatively flat orientation, parallel to and contacting the rear wall surface of a pocket when a credit card is inserted into position between the front and rear walls of the pocket. When a card is removed from the pocket, the spring steel locking tab is urged resiliently forward from the rear wall of the pocket by tension in the spring.

In a preferred, locking embodiment of a credit card wallet insert according to the present invention, the slidably mounted cover panel has protruding from a rear surface thereof a thin, elongated, flat-tab catch bar which is disposed vertically across the horizontally disposed upper access openings of a plurality of vertically staggered credit card compartment pockets that are stacked on top of one another. A rear, generally vertically disposed inner surface of the tab catch bar confronts each horizontally disposed locking tab positioned in an upper corner of each credit card compartment pocket, and slides readily over the compartments when each contains a credit card to thereby depress the locking tab into a flattened position in a pocket. Thus, with each credit compartment occupied by a credit card, the cover panel and rearwardly protruding tab catch bar are readily slidable laterally across the credit card compartment pockets.

In a preferred embodiment, the cover panel is slidably mounted to the credit card compartment by a slidable joint which includes a laterally disposed, rectangularly-shaped guide slot through the thickness dimension of the cover plate. A thin, rectangular guide boss protrudes outwardly through the guide slot from an outer surface of a lateral elongated, flat base panel which overlies the lower credit card compartment panel, below its upper access opening, the guide boss having a vertical height slightly less than that of the slot. The cover panel is retained slidably on the guide boss by a laterally elongated, rectangularly-shaped cover panel retainer plate which is fastened to an outer surface of the cover panel slide boss, the retainer plate having a height greater than that of the guide slot through the cover panel, and extending above and below the upper and lower edges of the slot to thereby confine motions of the cover plate to lateral directions relative to the base panel.

In preferred embodiments of a wallet insert according to the present invention, an upper laterally disposed edge of the cover panel is slidably retained to an upper laterally disposed edge of the credit card compartment by inverted, U-shaped hanger channel bracket, which has a downwardly protruding front leg attached to the front, outer surface of the cover panel, near the upper edge thereof. The U-shaped hanger channel bracket has a short, rearwardly disposed upper leg which protrudes rearwardly over the upper edge of the cover panel, from an upper edge of the front leg, and a rear leg which protrudes downwardly from a rear portion of the upper leg. The rear leg of U-shaped channel bracket has a front surface which slidably contacts a rear, horizontally disposed surface of a glide runner track, which consists of a thin, laterally elongated flat strip made of a flexible, low sliding-friction material such as a plastic, which is attached to the rear surface of the credit card compartment, parallel and adjacent to the upper edge of the compartment.

With the foregoing construction, the cover panel of the wallet insert is laterally slidable, e.g., to the left, past a vertical fold line between two adjacent vertical sections of a folding wallet that has been unfolded to provide access to contents of the wallet and/or wallet insert. When the cover panel has been slid laterally outwards, e.g., to the left, relative to the credit card compartment of the wallet insert, sufficiently far for the vertical tab catch bar to be positioned laterally outwards from outer vertical edges of the tab catch spring bars, one or more credit cards can be removed from individual pockets of the credit card compartment by grasping an upper right-hand edge of a card and withdrawing it vertically from a pocket through a horizontally disposed upper opening of the pocket. In a preferred embodiment, the cover panel has a vertically elongated, rectangularly-shaped notch cut from an upper right-hand corner of the cover panel, thus uncovering upper right-hand corners of the credit card compartment pockets to thereby enable easy access to upper right corners of credit cards inserted into the pockets.

As has been described above, removal of a credit card from a credit card compartment pocket of the wallet insert according to the present invention allows tension in a locking tab in the upper left-hand corner of the pocket to cause the outer, left-hand free end of the tab catch, which is made of an elastically deformable material such as spring steel, or a springy plastic, to spring forward. In this disposition, the outer left-hand end of the tab catch extends forward of the vertically disposed tab catch bar, which protrudes rearwardly from the cover panel. Thus, if an attempt is made to slide the cover panel rightwards towards a closed position, abutting contact of a right-hand vertical edge of the tab catch bar with one or more locking tabs which have been extended outwards upon removal of one or more credit cards, will prevent sliding the cover panel to a closed position unless and until a credit card has been re-inserted into each of the credit card compartment pockets. Moreover, the outer vertical edge of the outwardly deployed, extended cover panel, since it is positioned laterally outwards of the fold line between adjacent sections of the wallet, positively prevents the wallet from being folded closed, thereby preventing the wallet from being replaced in one's pocket or purse. When a user encounters this problem of not being able to close his or her wallet to return it to his pocket or her purse, he or she will be forced to take an appropriate action to enable the wallet to be closed. To remind the person of what action must be taken to enable the wallet to be closed, a RETURN CARD message is printed on the credit compartment, the message being visible only when the cover panel is slid to the open position.

A security wallet insert with locking slide cover panel according to the present invention as described above, is optionally manufactured as a component of a folding wallet, an accessory for installation in an existing folding wallet, or a self-contained credit card carrying case. When manufactured as a self-contained credit card case, the wallet insert according to the present invention may optionally be provided with a clip fastened to a rear surface of the wallet insert, the clip being adapted to be releasably clamped to a belt or pocket in the manner of a conventional money clip. When thus configured, the extended, locked cover panel of the wallet insert according to the present invention makes return of the insert to a belt, pocket or purse of the user difficult if not impractical, thus provided a strong incentive to a user to return credit cards to all pockets of the insert and thereby enable the cover panel to be returned to a closed position, overlying the credit card compartment.

According to the present invention, a wallet insert with a slidable, lockable credit card compartment cover panel as described above may include one of a variety of fastener devices to enable the insert to be conveniently installed in various types of folding wallets. For example, a basic embodiment of a security wallet insert according to the present invention is suitable for quick and easy installation into a conventional laterally elongated flexible wallet which has a vertical fold line that separates the wallet into left and right laterally elongated, rectangularly-shaped sections, including a left-hand section with an identification card window, and a right-hand, credit compartment section containing a stack of three or more laterally elongated credit card pockets. In this basic embodiment, a flat, U-shaped plastic spring clip is fastened to the rear surface of the credit card compartment of the wallet insert. The spring clip has in rear elevation view the shape of a U formed of left and right vertically disposed, rectangularly-shaped upright legs, and a horizontally disposed, rectangularly-shaped base leg. The base leg is elastically deformable rearward from the rear surface of the credit card compartment, and is of a suitable size and shape to be receivable vertically downwards into a horizontally disposed upper opening of the frontmost, lowest credit card pocket of an existing wallet. The U-shaped spring clip is held by a frictional fit and spring tension within a credit card pocket of the existing wallet, but preferably is further secured to the wallet by a strip of double-stick, pressure sensitive tape pressed between the rear surface of the wallet insert and the front surface of the credit card pocket in which it is installed.

A second embodiment of a security wallet insert which is also suitable for installation in a laterally elongated, single fold wallet of the type described above, has a fastener arrangement consisting of an elongated, rectangularly-shaped flexible tongue which protrudes laterally outwards from the rear surface of the credit card compartment portion of the wallet insert. The tongue is of a suitable size and shape to be insertably receivable in a vertically disposed pocket opening behind the identification window portion of an existing wallet, and retained therein by a frictional fit, and optionally securable therein by pressure sensitive tape.

Because the embodiments of the wallet insert described above are intended for use in single-fold wallets, which generally have two laterally elongated, rectangularly-shaped adjacent sections, including a credit card section, those embodiments of the present invention preferably have a generally rectangular, laterally or horizontally elongated shape. However, double-fold wallets typically have three adjacent sections, including a center section and two opposite end sections, which have a vertically elongated, rectangular shape. Accordingly, embodiments of a wallet insert suitable for use in double-fold wallets would according to the present invention, generally have a vertically elongated, rectangular shape.

Thus, a third embodiment of a security wallet insert with a slidable, lockable cover panel according to the present invention which is suitable for installation in a three-section, double fold wallet of the type which typically has three vertically elongated adjacent sections, including left and right side sections joined to a center section by left and right hinge folds, respectively, has a generally rectangular, vertically elongated front elevation view shape.

The double-fold wallet insert may optionally utilize as a fastening arrangement a U-shaped clip or laterally outwardly protruding flexible tongue, as described above. However, the double-fold wallet insert, as well as the single-fold insert described above, may optionally utilize a third type of fastener arrangement for attaching the insert to a wallet. This third type of fastener arrangement includes a tongue made of a thin sheet of metal, vinyl plastic, leather, or a similar material in the shape of a vertically elongated, rectangularly-shaped panel. The tongue is flexibly fastened at an outer vertical edge thereof to a rear surface of a rectangularly-shaped back panel of the wallet insert. In a preferred embodiment, the tongue is made of a thin, flexible sheet of PVC, leather or the like, which has a vertically disposed left-hand end strip which is bent 180 degrees forward from a longer, right-hand portion of the tongue. The end portion of the tongue is disposed parallel and adjacent to an outer left-hand vertical edge of the back panel, and is secured to the rear surface of the back panel in flush contact therewith by an suitable means, such as a pressure-sensitive adhesive bond; ultrasonic bond, thermosonic bond or the like.

The wide portion of the tongue is bent 180 degrees along a vertical fold line from the outer attachment portion of the tongue, the fold line being adjacent to the left-hand vertical edge of back panel of the wallet insert. Thus arranged, the tongue has a relatively wide, vertically elongated rectangular free end portion which has a free right-hand vertical edge. The latter is of a suitable size and shape to be insertably receivable into a left-hand vertical opening of a pocket formed behind a wallet credit card compartment comprising the right-hand section of a three-section, double-fold wallet.

According to another aspect of the present invention, a fourth embodiment of a security wallet insert for thwarting credit card loss utilizes a pivotable cover panel. This embodiment includes a small, rectangularly-shaped base panel which is fastened within a credit card compartment, as for example, in an upper left-hand corner of the lowest, outermost pocket of a staggered vertical sequence of pockets. This embodiment also has a laterally elongated, rectangularly-shaped cover panel which has a width slightly less than that of the credit card compartment. The cover panel is pivotably mounted to a front, outer surface of the base panel by a pivot axle which penetrates the lower left-hand corner of the cover panel and which is attached to an upper left-hand corner of the base panel. In a closed configuration, the cover panel is disposed horizontally and overlies the pockets of the credit card compartment. To obtain access to the pockets of the credit card compartment for the purpose of removing a credit card, the cover panel must be pivoted counterclockwise to an open configuration. Counterclockwise pivotable uncovering motion of the cover panel relative to the base panel is limited to a maximum excursion of ninety degrees, by a first, square cross section, opening abutment stop which protrudes upwardly from a lower left-hand corner portion of the front surface base panel, by abutting contact of the left-hand edge of the pivoted cover panel with an upper edge of the opening abutment stop. In this position, the cover panel protrudes leftwards beyond the fold line of a wallet in which the wallet insert is installed, and above the upper edge of the wallet, thus preventing the wallet from being closed.

A "RETURN CARD" message on the front surface of the credit card compartment, which is viewable only when the cover panel is pivoted counterclockwise towards an open position, informs a user that credit cards should be returned to the credit card compartment pocket, before closing the cover panel and thereby enable closing of the wallet. Closing is accomplished by pivoting the cover panel clockwise with respect to the base panel and credit card compartment. Clockwise, closing pivotable motion of the cover panel is limited to a maximum excursion of ninety degrees, by a second, square cross section, closing abutment stop which protrudes outwardly from the front surface of the base panel, at the right-hand edge and near the lower right-hand corner of the base panel. Clockwise motion is limited by abutting contact of a lower horizontal edge of the cover panel with an upper horizontal edge of the closing abutment stop.

According to another aspect of the present invention, a fifth embodiment of a security wallet insert for thwarting credit card loss utilizes a vertically pivotable or foldable cover panel. This embodiment includes a laterally elongated, rectangularly-shaped cover panel which is hingedly mounted along a laterally elongated, flexible linear hinge to the outer front edge of the lower credit pocket of a series of vertically staggered pockets of a credit card compartment. The width of the cover panel is slightly less than that of the credit card compartment, and the height of a suitable value to locate the upper horizontal edge of the cover panel above the upper edge of a credit card contained in the upper pocket of the compartment, i.e., adjacent to the upper edge of the compartment. This embodiment of a security wallet insert also includes a blocking arm mechanism for preventing downward opening movement of the cover panel to allow access to credit cards in the pockets of the credit card compartment, unless the blocking arm is pivoted to a non-blocking orientation.

A blocking arm mechanism for use with this embodiment of a security wallet insert may be similar in construction to that pivotable cover panel construction described above. In this case, the security wallet insert includes a small, generally square-shaped base panel which is fastened to a front surface of the lowest pocket of the credit card compartment, near the upper left-hand corner of the lowest compartment. A vertically elongated, rectangularly-shaped blocking arm or flag is pivotably attached at a lower end thereof to a generally centrally located pivot axle which protrudes outwardly from the base panel. The blocking arm has a vertical height which positions an upper, short horizontal edge thereof parallel and adjacent to the upper horizontal edge of the cover panel, when the flag arm is in a vertically disposed, closed position.

To enable access to credit card pockets, the blocking arm must be pivoted ninety degrees counterclockwise. Counterclockwise pivotable motion of the blocking arm relative to the base panel is limited to a maximum excursion of ninety degrees, by a first, square cross section, opening abutment stop, which protrudes upwardly from a lower left-hand corner portion of the front surface of the base panel, by abutting contact of the long, left-hand edge of the blocking arm with an upper edge of opening abutment stop. In this position, the blocking arm protrudes leftwards beyond the fold line of a wallet in which the wallet insert is installed, thus preventing the wallet from being closed. Also, with the blocking arm oriented in a counterclockwise, leftwardly extending orientation, the cover panel is unblocked, enabling it to be pivoted downwardly approximately 180 degrees from a closed position to an open position, thus allowing access to credit cards in pockets of the credit card compartment. A "RETURN CARD" message printed on the rear surface of the cover panel, which is visible only when the cover panel has been pivoted nearly 180 degrees downwardly to an open position from its upright, closed position, informs a user that credit cards should be returned to the credit card compartment pocket before closing the cover panel.

After credit cards have been returned to pockets of the credit card compartment, the cover panel may be pivoted upwards from an open position preventing retraction of the blocking arm, to an upstanding, closed position. With the cover panel in an upstanding, closed position, the blocking arm can be pivoted clockwise ninety degrees to a vertical position, thus removing the obstruction to closing a wallet in which the wallet insert is installed, and also blocking opening of the cover panel.

Clockwise, closing pivotable motion of the blocking arm is limited to a maximum excursion of ninety degrees, by a second, closing abutment stop which protrudes outwardly from the outer front surface of the base panel, near the upper right-hand corner thereof. Clockwise pivotable motion is limited by abutting contact of the long, right-hand edge of the blocking arm with a left-hand vertical edge of the closing abutment stop.

As described above, a sixth embodiment of a security wallet insert for credit cards according to the present invention may be constructed as a self-contained modification of the slidable, lockable basic embodiment, which provides a money clip-type clip. Other versions of the insert, such as those using a pivotable cover panel and blocking arm could also be constructed as self-contained credit card carrying cases.

BRIEF DESCRIPTION OF THE DRAWINGS

FIG. 11 is a front perspective view of the wallet and insert of FIG. 8, showing a locked cover panel of the insert preventing the wallet from being closed.

FIG. 12A is a perspective view of the wallet of FIGS. 8-11, showing credit cards removed from the middle and lower pockets of the wallet, as well as from the top pocket.

FIG. 12B is a right side elevation view of the wallet of FIG. 12A.

DESCRIPTION OF THE PREFERRED EMBODIMENTS

FIGS. 1-12B illustrate various aspects of a basic embodiment of a security wallet insert for credit cards according to the present invention. FIGS. 13-27 illustrate modifications of the basic embodiment of the invention.

Figure 1:
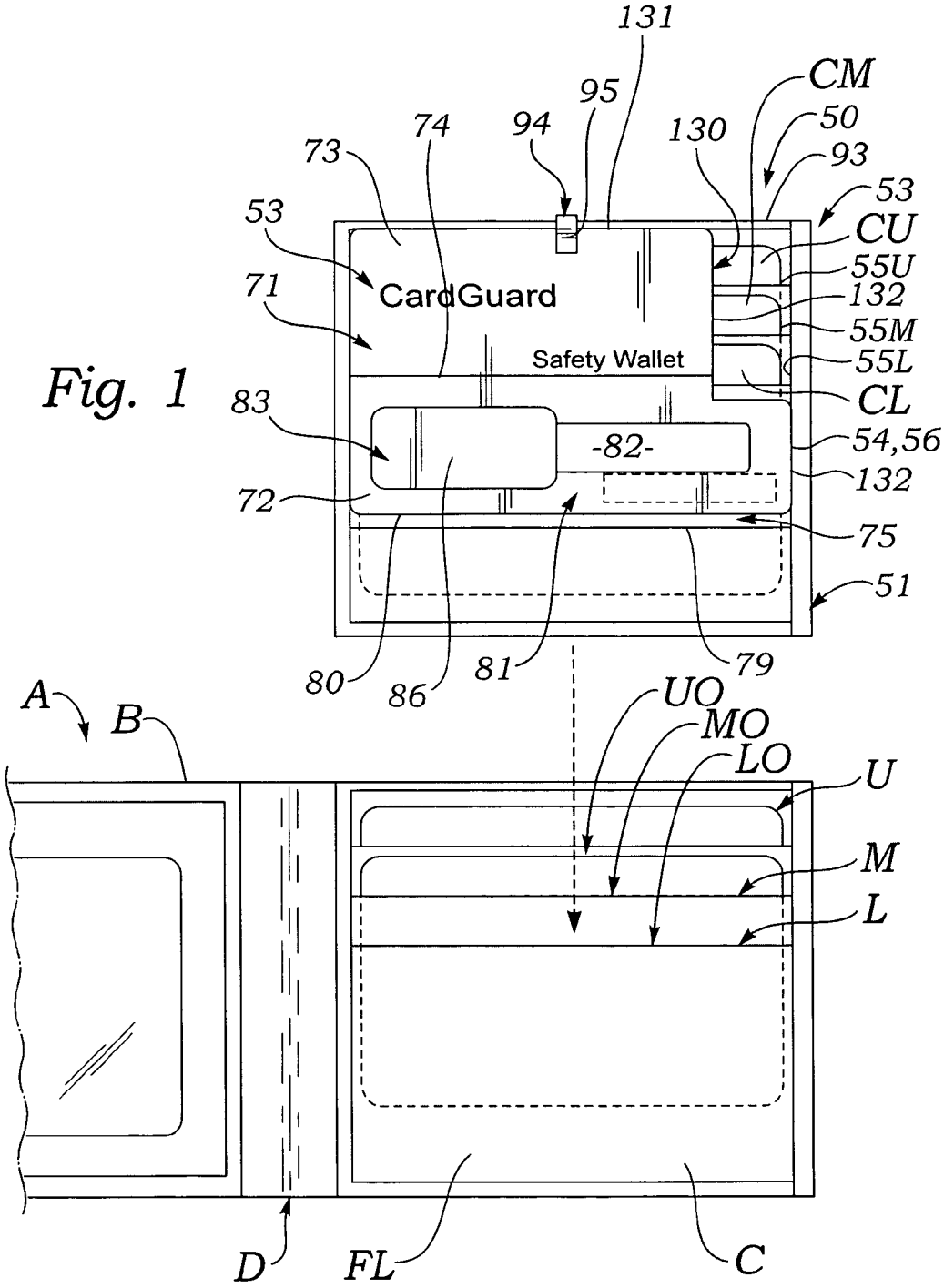
FIG. 1 is a front elevation view of a basic embodiment of a security wallet insert for credit cards according to the present invention, showing the insert positioned for installation in a wallet.
Figure 3:
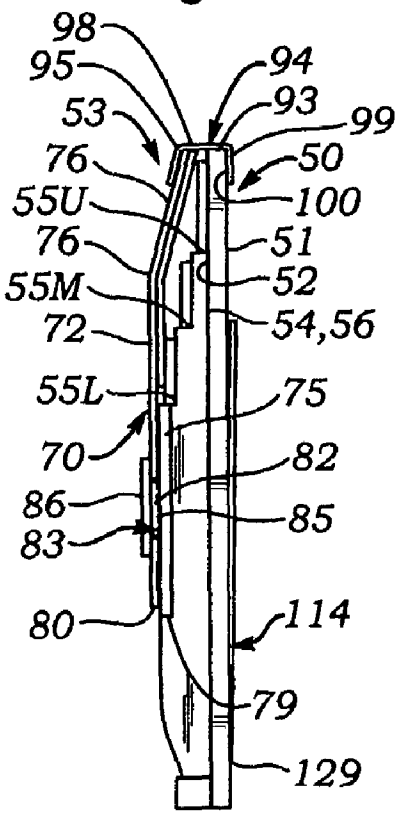
FIG. 3 is a fragmentary right-side elevation view of the insert of FIG. 2.
Figure 2:
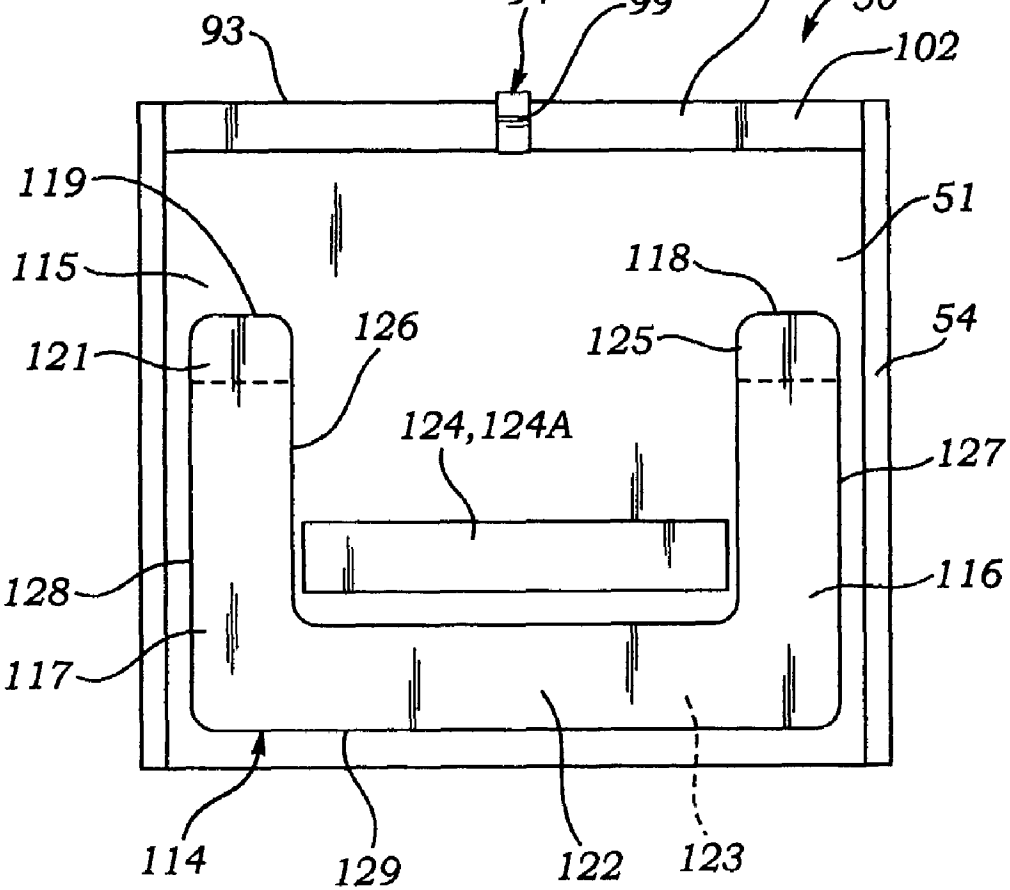
FIG. 2 is a rear elevation view of the insert of FIG. 1, on an enlarged scale.

Referring first to FIGS. 1-3, it may be seen that a basic embodiment 50 of a security wallet insert for credit cards according to the present invention includes a generally rectangularly-shaped, thin, flat rear base plate 51. Base plate 51 is made of any suitable material, such as a thin sheet of PVC plastic, metal, leather or the like, and has attached congruently to a front surface 52 thereof a credit card compartment 53. Credit card compartment 53 has in front elevation view a size and shape similar to that of base plate 51.

Credit compartment 53 of wallet insert 50 has a construction similar to that of the credit card compartment portion of a conventional wallet, such as the right-hand portion of the wallet shown in FIG. 1. Thus, credit compartment 53 is made of thin, flexible panels composed of natural or artificial leather, PVC plastic, or the like. As shown in FIGS. 1, 3, 7 and 11, credit card compartment 53 of security wallet insert 50 has a rear, floor panel 54 which has a size and shape similar to that of base plate 51, which it overlies and is fastened to. Thus, rear, floor panel 54 consists of a thin, rectangularly-shaped, flexible piece of material such as natural or artificial leather.

As shown in the figures, credit card compartment 53 includes a plurality of laterally elongated, rectangularly-shaped pockets 55 affixed to a front surface 56 of floor panel 54. Thus, as may be seen best by referring to FIG. 12A, credit card compartment 53 of security wallet insert 50 preferably has a lower, front pocket 55L, a middle pocket 55M, and an upper, rear pocket 55U. The exact number of pockets 55 is, of course, not critical, and credit card compartment 53 could have as few as one pocket 55, or more than three, although three or four is the number of pockets contained in the credit card compartment portion of a conventional wallet. As shown in FIGS. 1, 6, 7 and 12A, each pocket 55 has a laterally elongated, rectangularly-shaped front wall panel 57 which is joined to a similarly-shaped rear wall 58 along left, right, and bottom peripheral edges 59, 60, and 61, respectively, of the front and rear wall panels. As shown in those figures, the pockets 55 of credit card compartment 53 are stacked on top of one another and vertically staggered, in the conventional manner of arrangement of pockets of a credit card compartment of a conventional wallet. Thus, as shown in the figures, credit compartment 53 of wallet insert 50 is comprised of a rear wall panel 58U, and a front wall panel 57U. Front wall panel 57U has an upper laterally disposed edge 62U which is spaced downwardly from upper edge 63U of upper pocket 55U. The front panel 57U is flexibly attached at left, right and bottom peripheral edges 59U, 60U, and 61U thereof to rear wall panel 58U of upper pocket 55U, forming with the rear wall panel a rectangularly-shaped pocket space 64U. Pocket space 64U has a width slightly greater than that of a conventional credit card, i.e., about 3½ inches, and has a laterally disposed upper opening 65U for insertably receiving a credit card into the pocket space. Preferably, the upper edge 62U of upper pocket 55U is located at a height above bottom edge 61U of the pocket about a quarter of an inch less than the height of a conventional card. Thus, when a credit card is fully inserted into a pocket, such as upper pocket 55U; with a lower edge of the card resting on the inner surface of the bottom peripheral edge 51U of the pocket, the upper forwardly disposed edge of the credit card protrudes about the one-quarter inch above the front pocket edge wall, enabling an upper edge of the credit card to be easily grasped when removing and re-inserting the credit card into the pocket.

Figures 8, 9, 10:
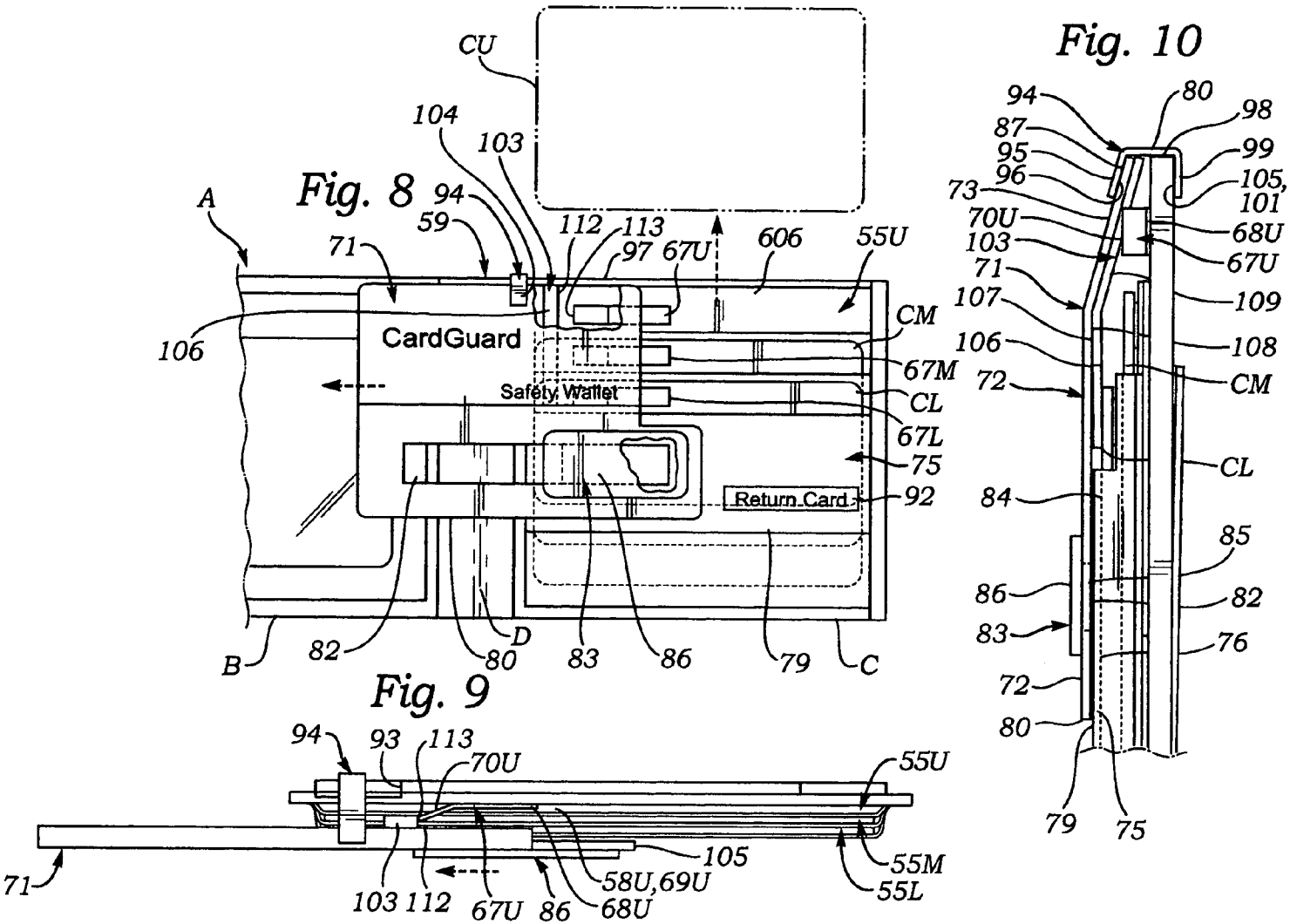
FIG. 8 is a partly broken-away view of the insert of FIG. 5, showing a cover panel of the insert slid to the left to enable removal of a credit card from the wallet.
FIG. 9 is an upper plan view of the wallet and insert of FIG. 8.
FIG. 10 is a right side elevation view of the wallet and insert of FIGS. 8 and 9.

As may be seen best by referring to FIGS. 8, 9, 12A and 12B, each pocket 55 has attached to an upper left-hand corner region 66 of rear wall panel 58 thereof a rectangularly-shaped, laterally elongated, horizontally disposed flat, resilient locking tab 67 which is made of resilient material such as a flexible, elastically deformable plastic or spring steel. As shown in FIGS. 8 and 9, each locking tab has a flat, straight right-hand portion which is fastened in flat overlying contact to a front surface 69 of a rear wall panel 58. Each locking tab 67 also has a resilient left-hand portion 70 which is biased or sprung outwardly from the straight right-hand portion, i.e., forward from front surface 69 of rear wall panel 58. The function of locking tabs 67 will be described in detail below.

Figure 6:
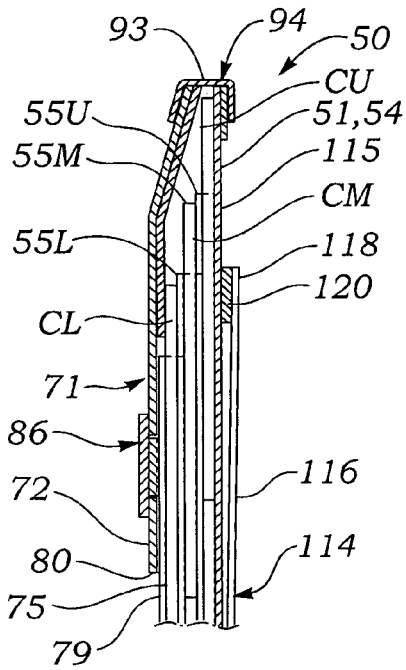
FIG. 6 is a vertical sectional view of the insert of FIG. 4, taken in the direction of line 6-6.
Figure 7:
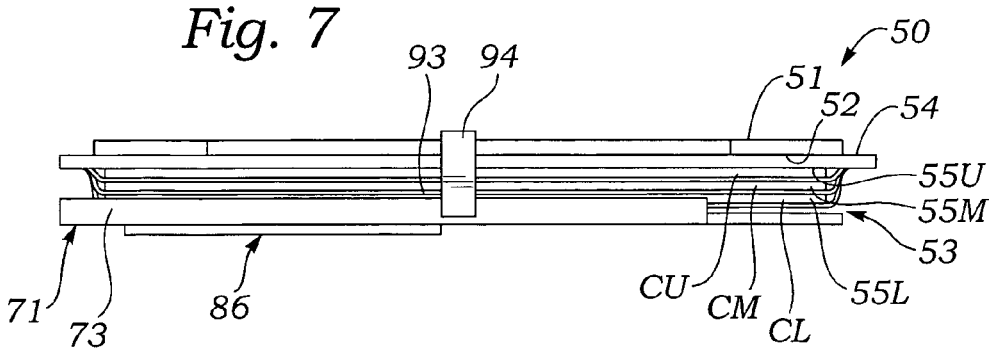
FIG. 7 is an upper plan view of the insert of FIG. 5.

As shown in FIGS. 1, 3 and 6, when a credit card C is installed in a pocket 55 of credit card compartment 53, a snug fit of the credit card within the pocket presses rearwardly on outer left-hand portion 70 of locking tab 67, thus overcoming spring tension in the locking tab and forcing the left-hand portion of the locking tab into generally parallel alignment with front surface 69 of rear wall panel 58 of the pocket.

Referring now to FIGS. 1 and 3, it may be seen that security wallet insert 50 includes a front cover panel 71 which overlies pockets 55 of credit card compartment 53 when the cover panel is positioned in a closed, right-hand position. When cover panel 71 is slid laterally to the left of credit compartment 53, as shown in FIGS. 8 and 9, credit card compartment pockets 55 are sufficiently unobstructed to enable credit cards to be removed from and replaced in the pockets.

As shown in FIGS. 1 and 3, cover panel 71 has the shape of a thin, generally rectangularly-shaped plate, including a lower laterally elongated rectangular slide bar portion 72 and an upper rectangularly-shaped cover plate portion 73, which angles rearwardly slightly from an upper horizontal edge 74 of the slide bar.

As shown in FIGS. 1, 3 and 8, slide bar 72 overlies a similarly shaped, laterally elongated rectangular slide support base plate 75 which is fastened to outer, front surface 76 of front wall panel 57L of lowest, outermost or front credit card compartment pocket 55L. Preferably, slide bar plate 75 is made of a thin sheet of a relatively low coefficient friction material such as PVC plastic, with an upper horizontal edge 77 of the slide support base plate adjacent to upper edge 78 of front wall panel 57L. The exact vertical height of slide support base plate 75 is not critical, and it may be slightly less than that of slide bar 72 of cover panel 71, or slightly greater, and thereby having a lower edge 79 which protrudes below lower edge 80 of the slide bar, as shown in the figures.

Referring to FIGS. 1-9, it may be seen that slide bar 72 of cover panel 71 is slidably mounted to slide base plate 75 by a slide joint 81. Slide joint 81 includes a laterally disposed, rectangularly-shaped guide slot 82 which penetrates the thickness dimension of slide bar 72. Slide joint 81 also includes a thin, rectangular cross-section guide boss 83 which protrudes outwardly forwards from an outer surface 84 of slide support base plate 75. As shown in FIGS. 1 and 3, guide boss 83 has a rectangular cross-section base 85 which protrudes outwardly forward through slot 82 of slide bar 72. The vertical height of guide boss base 85 is slightly less than the height of slot 82, thus enabling the slide bar to slide laterally with respect to the guide boss.

Slide bar 72 of cover panel 71 is slidably retained on guide boss 83 by a laterally elongated, rectangularly-shaped cover panel retainer plate 86 which is fastened to a front, outer surface of boss base 85, the retainer plate having a vertical height greater than that of slot 82, and having upper and lower edges 87, 88 which protrude above and below upper and lower edges 89, 90, respectively, of the slot. With this construction, cover panel 71 is laterally slidable with respect to slide base plate 75 fixed to credit compartment 53, between a closed position covering pockets 55 of the credit card compartment, as shown in FIGS. 1, 4, 5 and 7, and an open position which affords access to the pockets, as shown in FIGS. 8 and 9.

Referring now to FIGS. 1, 2 and 7-10, it may be seen that an upper portion of cover plate 73 of cover panel 71 is slidably retained to an upper laterally disposed edge 93 of credit card compartment 53 by a hanger bracket 94. Hanger bracket 94 has the shape of a thin, inverted U-shaped bar which has a downwardly protruding front leg 95 that has a rear surface 96 and is attached at lower end thereof to front surface 97 of cover plate 73. Bracket 94 also has a short, horizontal, rearwardly disposed upper leg 98 which protrudes rearwardly from an upper end of front leg 95, and a rear leg 99 which protrudes downwardly from a rear portion of the upper leg. Rear leg 99 of hanger bracket 94 has a front surface 100 which slidably contacts a rear, horizontally disposed surface 102 of a glide runner track 101. Glide runner track 101 consists of a thin, laterally elongated rectangularly-shaped flat strip made of a flexible, low sliding-friction material such as a plastic, which is attached to credit card compartment 53, parallel and adjacent to the upper edge of the compartment.

As shown in FIGS. 8, 11 and 12A, when cover panel 71 is slid laterally outwards to the left from credit compartment 53, sufficiently far for the right-hand vertical edge of hanger bracket 94 to be spaced to the left-hand edge of credit card in pockets so a credit card may be removed from a pocket 55 of the credit card compartment. In this position, the left-hand vertical edge 91 of cover panel 71 extends beyond a vertical hinge or fold line D between left and right-hand sides B and C of a wallet A in which insert 50 is installed. In this open, laterally outwardly translated position of cover panel 71 relative to credit card compartment 53, as shown in FIG. 11, a "RETURN CARD" message 92 printed on the front, outer surface of slide base plate 75, which is covered by cover panel slide bar 72 when the cover panel is in its right-hand position overlies credit card pockets 50, as shown in FIG. 1, is viewable. Thus, when a person attempts to close wallet A after making a transaction using a credit card from a pocket 55 of credit card compartment 53, abutting contact of left-hand edge 91 of cover panel 71 with left-hand side B of wallet A provides a tactile stimulus to a person that an action should be taken before closing the wallet, and the visual stimulus offered by "RETURN CARD" message 92 informs the person of what that action must be. Moreover, as will now be explained, wallet insert 50 preferably includes a locking mechanism which positively prevents cover panel 71 from being slid laterally rightwards to a closed position, thus preventing the wallet from being closed, until a credit card is returned to each pocket 55 of credit card compartment 53.

The basic embodiment 50 of a security wallet insert according to the present invention preferably includes a locking mechanism for positively locking cover panel 71 in a position extending laterally outwards from credit card compartment 53, beyond hinge D between left and right halves of wallet A, and thereby preventing the wallet from being folded closed, until all credit cards C that have been removed from pockets 55 have been returned to the pockets. As may be seen best by referring to FIGS. 8-10, the locking mechanism including a thin, rectangularly-shaped tab-catch bar 103 that is attached to the rear surface of cover panel 71. As shown in FIGS. 8-10, tab-catch bar 103 is located to the right of right-hand edge 104 of hanger bracket 94 which is approximately laterally centrally located between left-hand vertical edge 91 and right-hand vertical edge 105 of cover panel 71. As shown in FIGS. 8-10, tab-catch bar 103 has a vertically disposed lower portion 106 which has a front surface 107 fastened in flush contact to rear surface 108 of lower, slide bar base 72 of cover panel 71. Tab-catch bar 103 also has an upper portion 109 which angles rearwardly from lower portion, the upper portion having a front surface 110 which is fastened in flush contact to rear surface 111 of upper, cover plate portion 73 of cover panel 71.

When a credit card is removed from a pocket 55 of credit card compartment 53, such as a credit card CU removed from upper compartment 55U, as shown in FIG. 9, the left-hand portion 70 of a locking tab 67, e.g., upper pocket locking tab 67U, springs resiliently forward. In this sprung forward position, when an attempt is made to slide cover panel rightwards to a closed position, the right-hand edge 112 of tab-catch bar 103 abuts left-hand edge 113 of locking tab 67, as shown in FIG. 9, preventing the cover panel from being slid rightwards to a closed position. Replacing credit cards C in all pockets 55 presses all locking tabs 67 rearwardly into their respective pockets 55, thus enabling tab-catch bar 103 to slide freely over the front surfaces of the credit cards, thereby enabling cover panel 71 to be slid rightwards to a fully closed position covering credit card compartment 53, as shown in FIG. 1.

FIGS. 1, 2, 4 and 6 illustrate structural characteristics which enable security wallet insert 50 to be quickly and easily installed, or retrofitted, into an existing two compartment single fold wallet.

As shown in FIG. 1, a single fold wallet A for receiving security wallet insert 50 has two generally rectangularly-shaped, left and right compartments B and C joined along a fold line D. Right-hand compartment C of wallet insert A has a plurality, e.g., three, of open-top pockets, including a front, lower pocket L, a middle pocket M, and a rear, upper pocket U, each having a generally rectangularly shape of the appropriate size to receive through an opening LO, MO, and UO, respectively thereof, a standard size thin plastic credit card.

Referring to FIGS. 2 and 3, it may be seen that wallet insert 50 has a thin, flat U-shaped, plastic or metal spring clip 114 which is attached to rear surface 115 of base plate 51 of the wallet inert. Spring clip 114 has a pair of left and right vertically disposed, rectangularly-shaped legs 116, 117, which are attached near upper horizontal edges 118, 119 thereof, by thin resilient, mounting pads 120, 121 to rear surface 115 of base panel 51. Spring clip 114 also has a laterally elongated, rectangularly-shaped base leg 122 disposed horizontally between lower ends of vertical legs 116, 117. A front, inner surface 123 of base leg 122 is biased resiliently into contact with outer, rear surface 115 of base panel 51, by resilient mounting pads 120, 121. Preferably, means for fastening security wallet insert 50 to a wallet also includes an optionally useable strip of double-stick, pressure sensitive mounting tape, such as a rectangular strip 124 fastened to rear surface 115 of base plate 51 and disposed horizontally between inner sides 125, 126 of vertical spring clip legs 116, 17.

Figure 4:
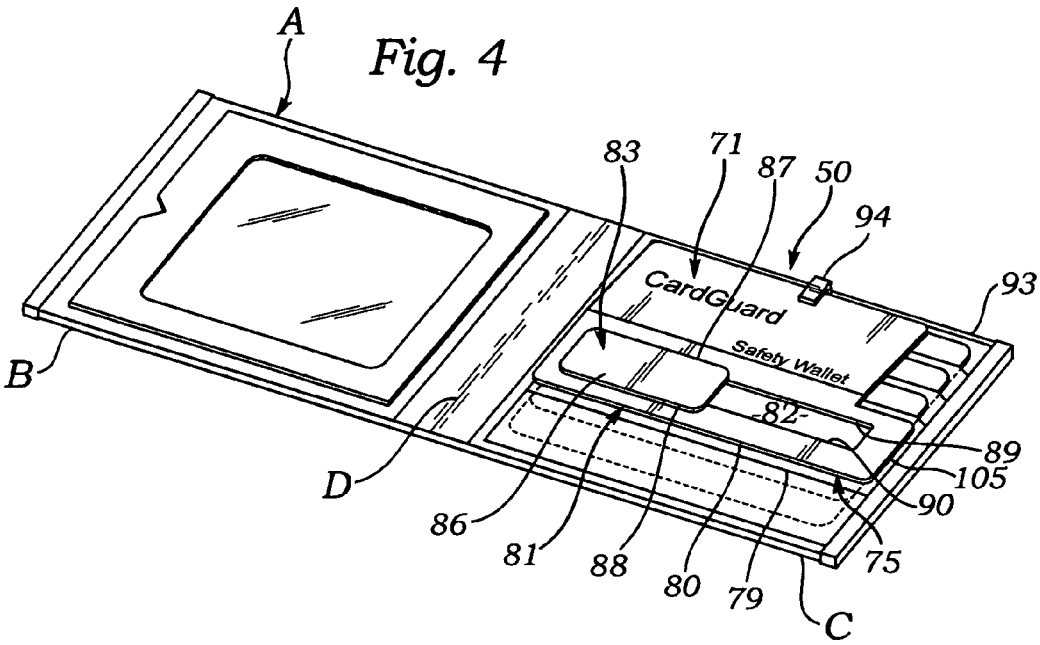
FIG. 4 is a perspective view of the insert of FIG. 1, showing the insert installed in a wallet.
Figure 5:
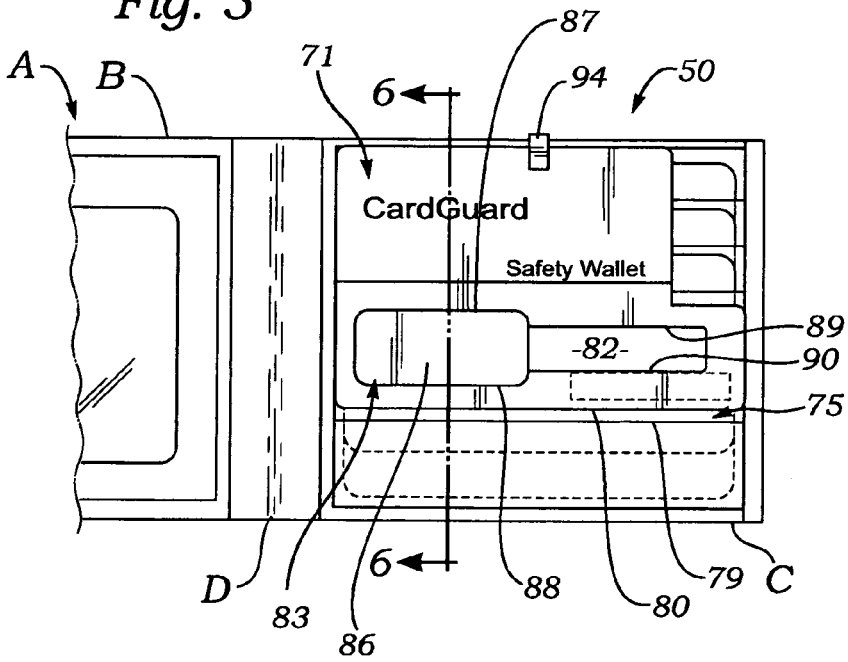
FIG. 5 is a fragmentary front elevation view of the insert and wallet of FIG.

The lateral spacing between outer vertical edges 127, 128 of left and right vertical spring clip legs 116, 117, has a value equal to the width of a standard credit card. Moreover, the thickness of spring clip 114 is the same as that of a standard credit card. Thus constructed the lower lateral edge 129 of spring clip 114 is positionable above opening LO of lower pocket L of credit card compartment C of wallet A, and pushed downwardly into the pocket opening sufficiently far for lower edge 129 of the spring clip to rest on the bottom inner edge BL of the lower pocket, as shown in FIG. 5, thus securing a wallet insert within the wallet, as shown in FIGS. 4 and 5. To further secure wallet insert 50 within wallet A, a protective cover sheet 124A covering a rear, adhesive-coated surface of mounting strip 124 may be peeled off prior to inserting spring clip 114 into pocket L, and after the clip has been inserted, pressing the adhesive-coated rear surface of the mounting strip into adhering contact with front wall FL of the lower pocket.

As may be seen best by referring to FIG. 1, cover panel 71 os insert 50 preferably has a vertically elongated, rectangularly-shaped notch 130 cut into the intersection of upper edge 131 and right-hand edge 132 of the cover panel, thus uncovering upper right-hand corners of credit card compartments 55, and thereby enabling easy access to upper right-hand corners of credit cards inserted into the pockets, to facilitate removal of a selected credit card.

Figure 13:
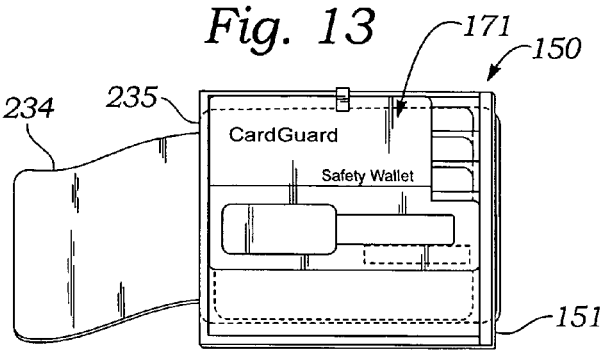
FIG. 13 is a front perspective view of a second embodiment of a security wallet insert for credit cards according to the present invention.
Figure 14:
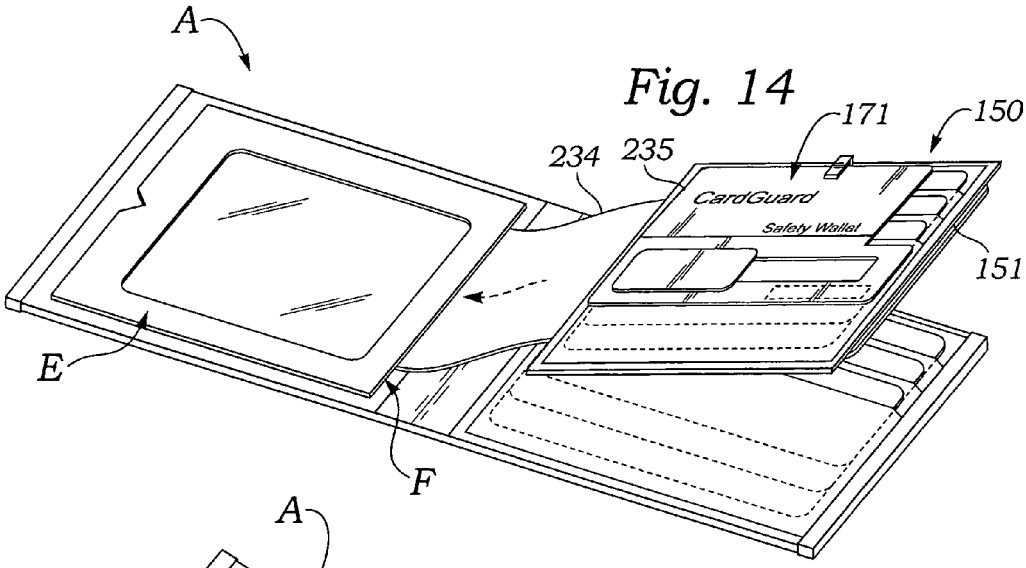
FIG. 14 is a front perspective view of the insert of FIG. 14, showing how the insert is installed in a vertically disposed side opening of an identification card compartment of a standard single-fold wallet
Figure 15:
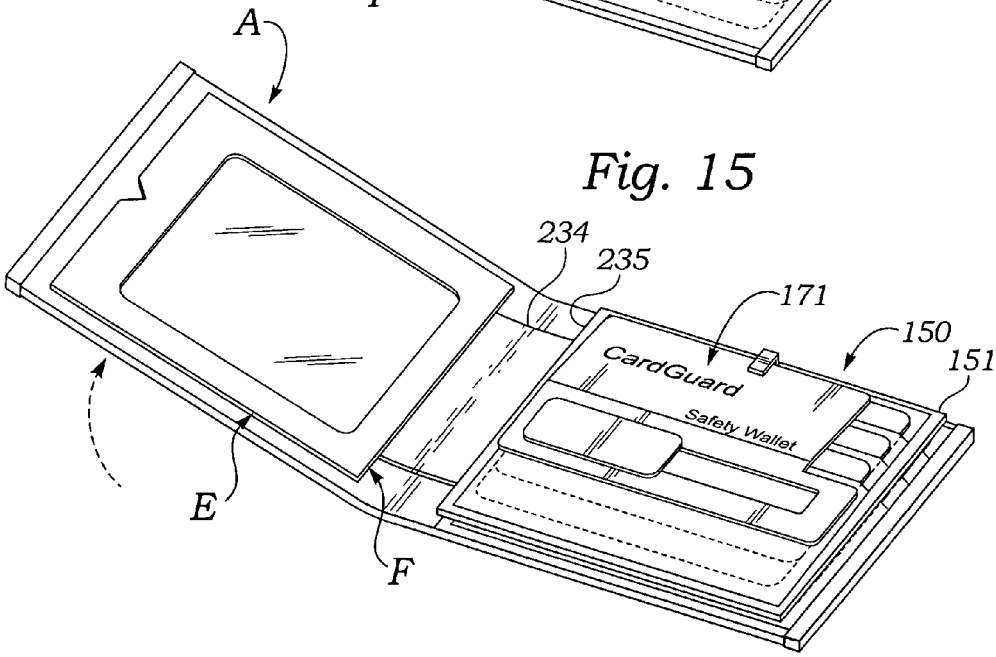
FIG. 15 is a perspective view of the insert and wallet of FIG. 14, showing the insert fully installed in the wallet.

FIGS. 13-15 illustrate a second embodiment 150 of a security wallet insert for credit cards according to the present invention. The second embodiment 150, as well as the basic embodiment 50 described above, is suitable for use in a laterally elongated, single fold wallet of the type shown in FIGS. 1, 4, 5, 8 and 11.

As may be seen by referring to FIGS. 1 and 13, security wallet insert 150 is substantially similar in construction and function to insert 50 described above, but has a different means of attachment to a wallet A. Thus, while embodiment 50 uses a spring clip 114 as a means of attachment, as shown in FIGS. 2 and 3, insert 150 is provided with a flexible rectangularly-shaped tongue 234 which protrudes laterally outwards form a vertical side edge 235 of the insert. Tongue 234 is preferably made of a thin, flexible sheet of metal or plastic such as a vinyl, and is of an appropriate size to be slidably and frictionally received within a vertically disposed opening F of an identification window E of wallet A.

FIGS. 16-19 illustrate a third embodiment 250 of a security credit card holder wallet insert according to the present invention, which is especially suitable for use with double-fold wallets of a type which have three adjacent sections of similar size and shape, including a center section and two opposite side end sections, each of which has a vertically elongated, rectangular shape.

Figure 18:
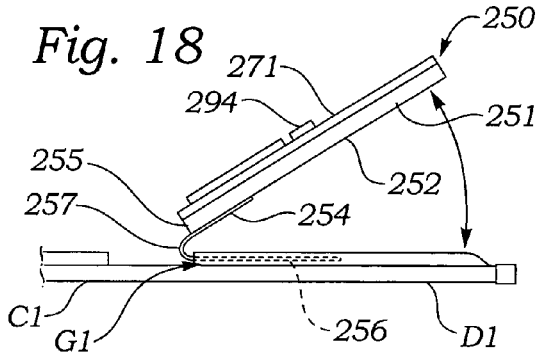
FIG. 18 is a lower plan view of the insert of FIG. 16, showing how the insert is installed in a wallet.
Figure 16:
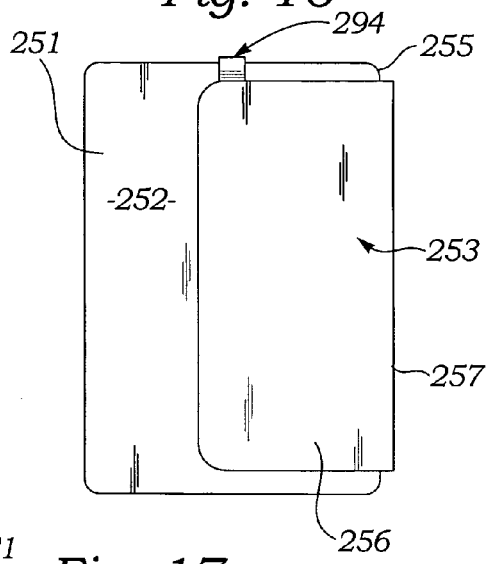
FIG. 16 is a rear elevation view of a third embodiment of a security wallet insert for credit cards according to the present invention.
Figure 17:
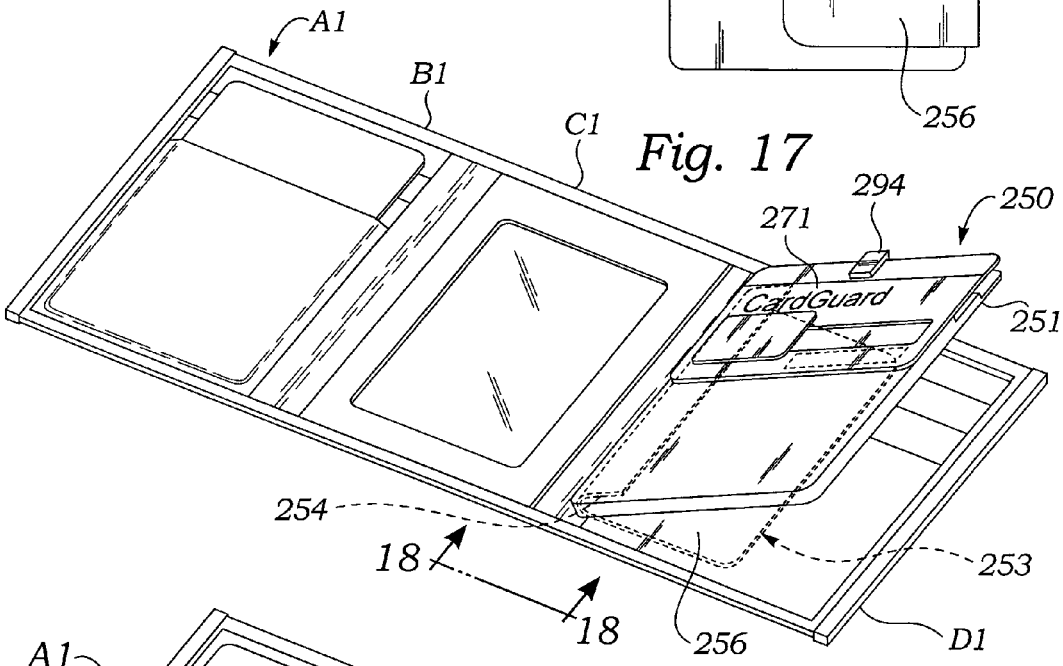
FIG. 17 is a front perspective view showing the insert and wallet of FIG. 16.
Figure 19:
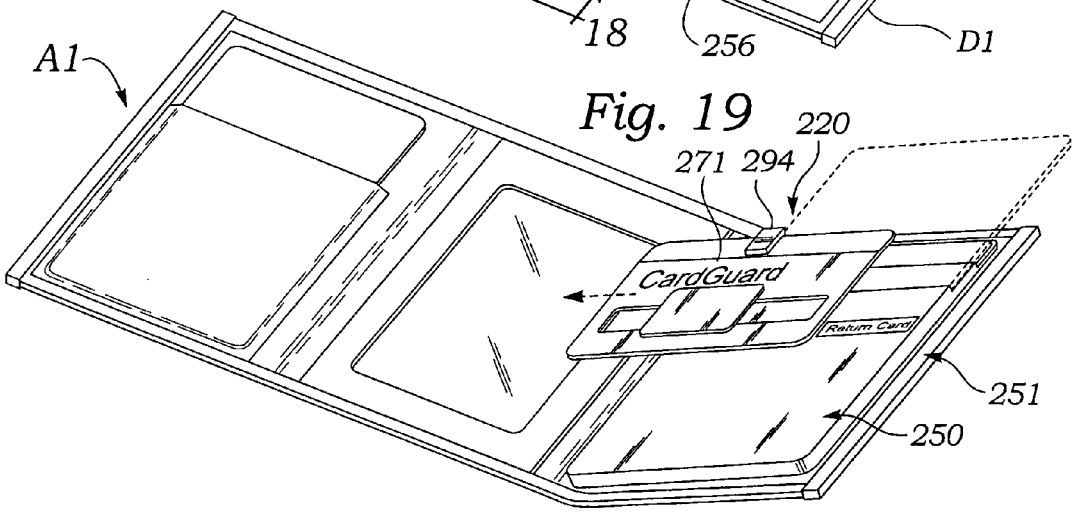
FIG. 19 is a perspective view of the insert and wallet of FIG. 18, showing a cover panel of the insert slid to the left to enable a credit card to be removed from the wallet, the cover panel abutting the center of the wallet to thereby prevent the wallet from being closed.

Referring FIGS. 16-19, a security insert 250 for use with double-fold wallets may be seen to be similar in construction and function to insert 150 described above. However, as shown in FIGS. 16-18, security wallet insert 250 has a rectangular shape which is vertically elongated, of a shape and size similar to that of the left, middle and right-hand sections B1, C1 and D1 of a dual fold wallet A1. Insert 250 has attached to rear surface 252 of a flat, rectangularly-shaped rear base plate 251 thereof a vertically elongated, rectangularly-shaped hinged attachment tongue 253.

As shown in FIGS. 16 and 18, attachment tongue 253 has a fixed end portion 254 which is located laterally inwards of an outer vertical edge 255 of insert base panel 251. End portion 254 is fastened to rear surface 252 of base panel 251 by suitable means, such as an adhesive bond. Attachment tongue 253 also has a vertical elongated rectangularly-shaped free outer insert portion 256 which is bent inwardly and forwardly from fixed inner end portion 254 along a vertically disposed hinge or fold line 257. As shown in FIGS. 17 and 18, insert portion 256 of attachment tongue 253 is of a suitable size and shape to be insertably and frictionally receivable within a vertically disposed inner opening of an outer wallet compartment, e.g., left-hand opening G1 of right-hand compartment D1.

Figure 20:
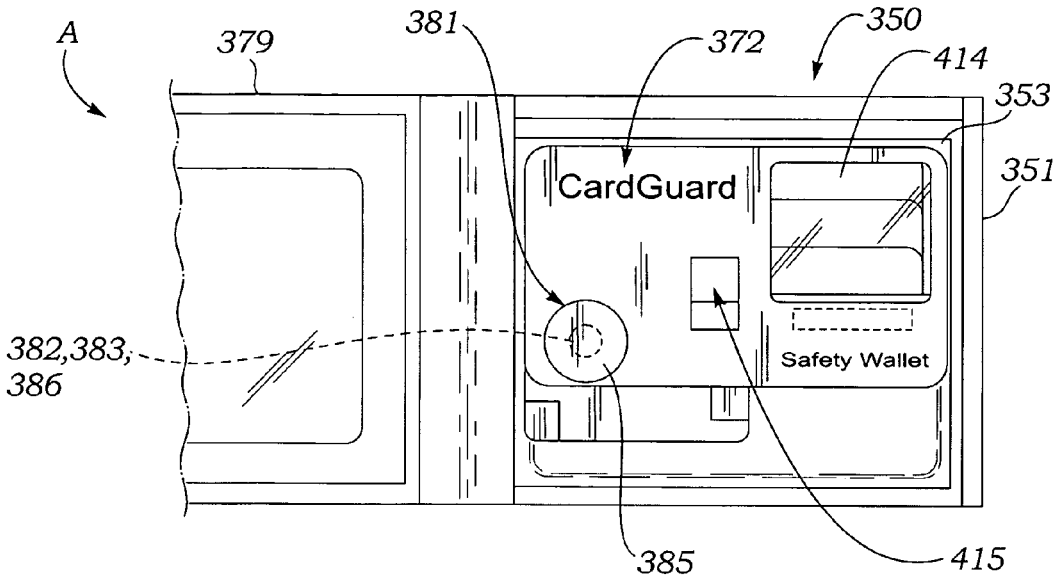
FIG. 20 is a front elevation view of a fourth embodiment of a security wallet insert for credit cards according to the present invention, showing the insert installed in a wallet.
Figure 21:
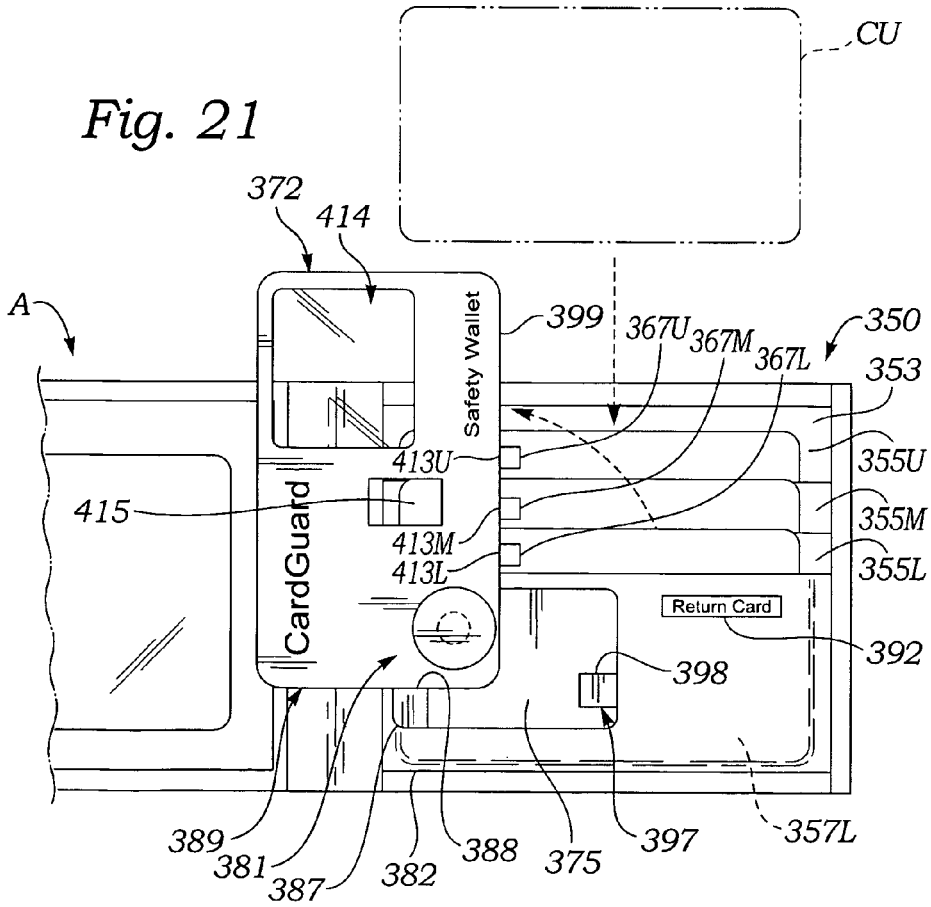
FIG. 21 is a view similar to that of FIG. 20, but showing a cover panel of the insert rotated counterclockwise to enable a credit card to be removed from the wallet, the cover panel abutting a left-hand panel of the wallet to prevent it from being closed.

FIGS. 20 and 21 illustrate a fourth embodiment 350 of a security wallet insert for holding credit cards according to the present invention. Insert 350 includes a generally rectangularly-shaped base panel 351 which is similar in construction to the base panels of embodiments 50, 150 and 250 described above, and which is provided with one of the previously described structures for attaching the insert to a wallet, such as wallet A shown in FIGS. 20 and 21.

As may be seen best by referring to FIG. 21, insert 350 has a plurality of vertically staggered credit card compartments, e.g., upper, middle and lower compartments 355U, 355M, 355L. Outermost, lower credit card compartment 355L has fastened to the outer front surface of an outer front wall panel 357L thereof a thin, flat, rectangularly-shaped base plate 375, made of a relatively rigid material such as a thin metal or hard plastic.

As shown in FIGS. 20 and 21, insert 350 includes a thin, laterally elongated, rectangularly-shaped cover plate 372 which is pivotably mounted to base plate 375 at a lower left-hand corner of the cover plate by a pivot joint 381. Pivot joint 381 includes a circular perforation 382 which is disposed through the thickness dimension of cover plate 372, near a lower left corner of the cover plate. Pivot joint 381 also includes a thin, circular cross-section pivot boss 383 which protrudes outwardly forwards from an outer surface 384 of base plate 375 and through perforation 382 through cover plate 372.

Cover plate 372 is pivotably retained on pivot boss 383 by a thin, circular cross-section retainer disk 385 which is fastened to front, outer surface 386 of pivot boss 383, the retainer disk having a larger diameter than perforation 382 through cover plate 372. The above-described construction of pivot joint 381 disposed between cover plate 372 and base plate 375 enables the cover plate to be pivoted counterclockwise to an open position from a closed position overlying credit cards, e.g., CU, CM, CL in pockets 355U, 355M, 355L. Counterclockwise pivotal opening motion of cover plate 372 relative to base plate 375 is required to enable access to credit cards in compartments 355, as shown in FIG. 21. Counterclockwise pivotal opening motion of cover panel 372 is limited to a maximum excursion of ninety degrees by a first, rectangular cross-section, opening abutment stop 387, which protrudes from a lower left-hand corner of base plate 375. Opening abutment stop 387 is made of a thin sheet of rigid material such as metal or plastic which has a horizontally disposed upper edge wall 388 that abuts the left-hand edge wall 389 of cover plate 372, when the cover plate is pivoted ninety degrees counterclockwise from a closed, covering position, as shown in FIG. 20, to a counterclockwise open, access position, as shown in FIG. 21.

A "RETURN CARD" message 392 is printed on front surface 357L of lower credit card pocket 355L, which is viewable only when the cover panel is pivoted counterclockwise to an opened access position, informs a user that credit cards should be returned to credit card compartment pockets, before pivoting cover panel 372 clockwise to a closed position which enables closing of wallet A. Clockwise, closing pivotal motion of cover panel 372 relative to base plate 375 is limited to a maximum excursion of ninety degrees. This limitation is accomplished by a second, rectangular cross-section closing abutment stop 397 which protrudes from a lower right-hand corner of base plate 375. Closing abutment stop 397 is of similar construction to opening abutment stop 387, and has a horizontally disposed upper edge wall 398 which abuts the lower edge wall 399 of cover plate 372, when the cover plate is pivoted ninety degrees clockwise from an opened, access position, as shown in FIG. 21, to a closed position covering credit cards, as shown in FIG. 20.

As shown in FIG. 21, insert 350 is optionally provided with resilient locking tabs 367U, 367M, 367L positioned in the upper left-hand corners of pockets 355U, 355M, and 355L, respectively. With this construction, when a credit card is removed from a pocket 355U, 355M or 355L, a resilient locking tab 367U, 367M, 367L springs resiliently forward. In that position, when an attempt is made to pivot cover panel 372 clockwise to a closed position, the lower edge 399 of the cover panel abuts a left-hand edge 413 of a locking tab, thus preventing the cover panel from being returned to a closed position. Replacing a credit card C in each pocket 355 presses all locking tabs 367 rearwardly into flush contact with the rear walls of the pockets, thus enabling cover panel 372 to slide freely over the front surfaces of the credit cards, thereby enabling the cover panel to be pivoted clockwise to a fully closed position covering credit card compartment 353, as shown in FIG. 20.

As shown in FIGS. 20 and 21, cover panel 372 is preferably provided with apertures or windows through which credit cards in compartments 355 may be viewed. Thus, as shown in FIGS. 20 and 21, cover panel 372 has through its thickness dimension a rectangularly-shaped viewing aperture 414 located in the upper right-hand corner region of the cover panel, and a smaller rectangularly-shaped viewing aperture 415 located in a lower central region of the cover panel.

Figure 22:
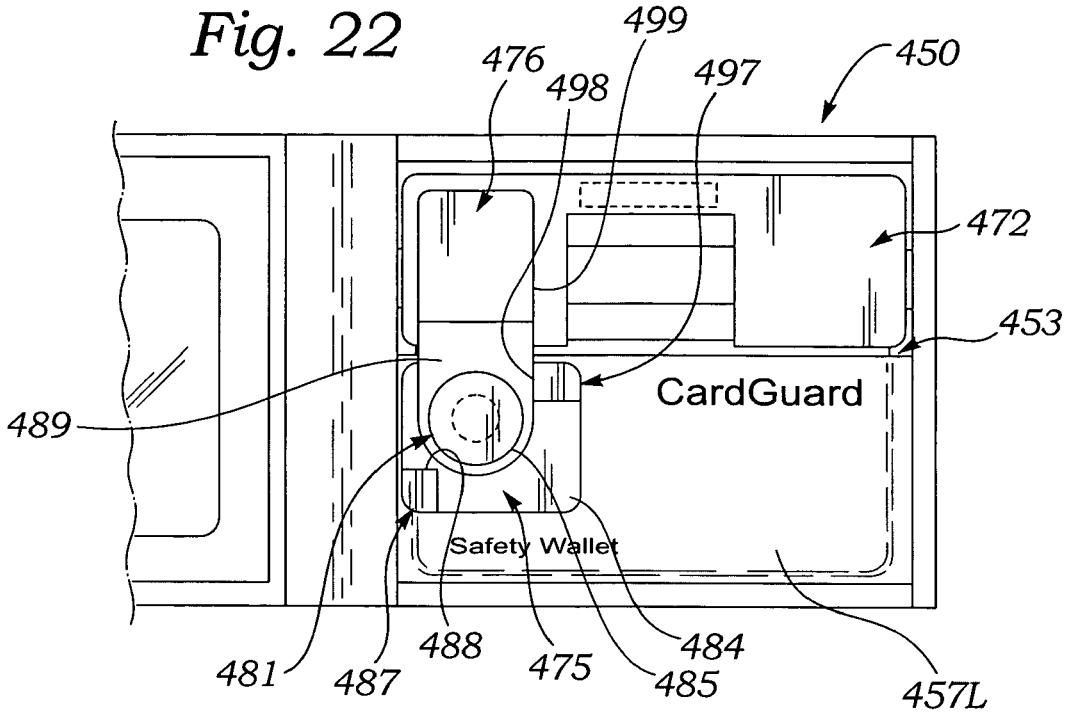
FIG. 22 is a front elevation view of a fifth embodiment of a security wallet insert for credit cards according to the present invention.
Figure 23:
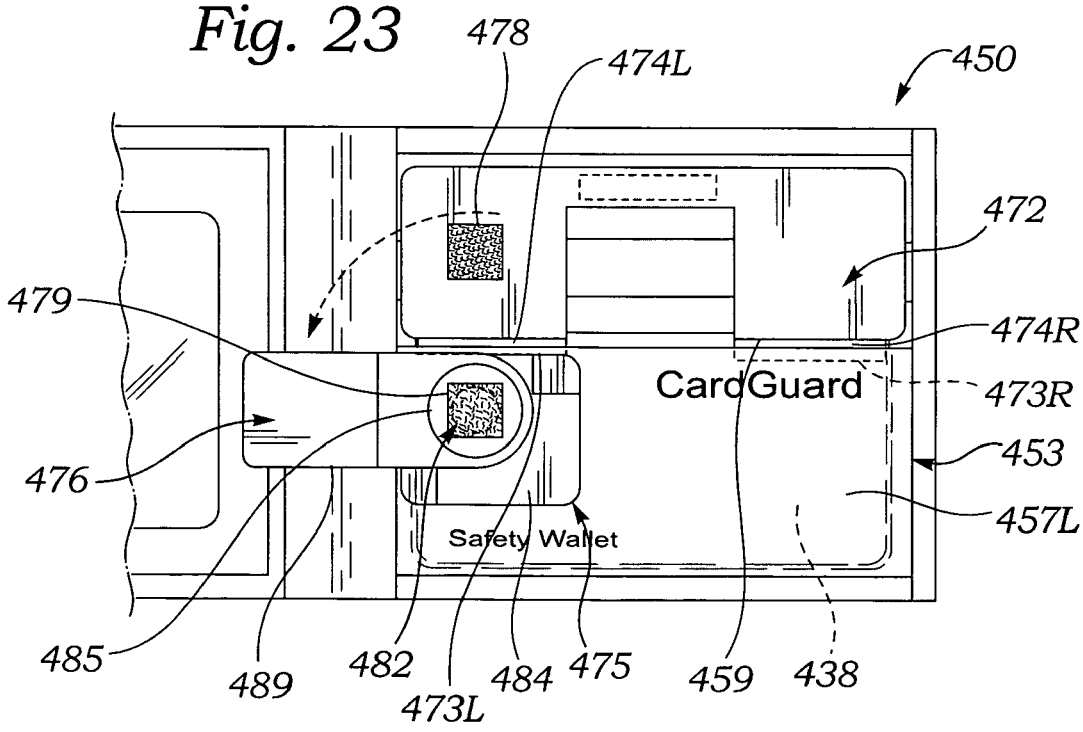
FIG. 23 is a view similar to that of FIG. 22, showing a flag arm thereof rotated ninety degrees clockwise to enable a cover panel thereof to be pivoted forward.
Figure 24:
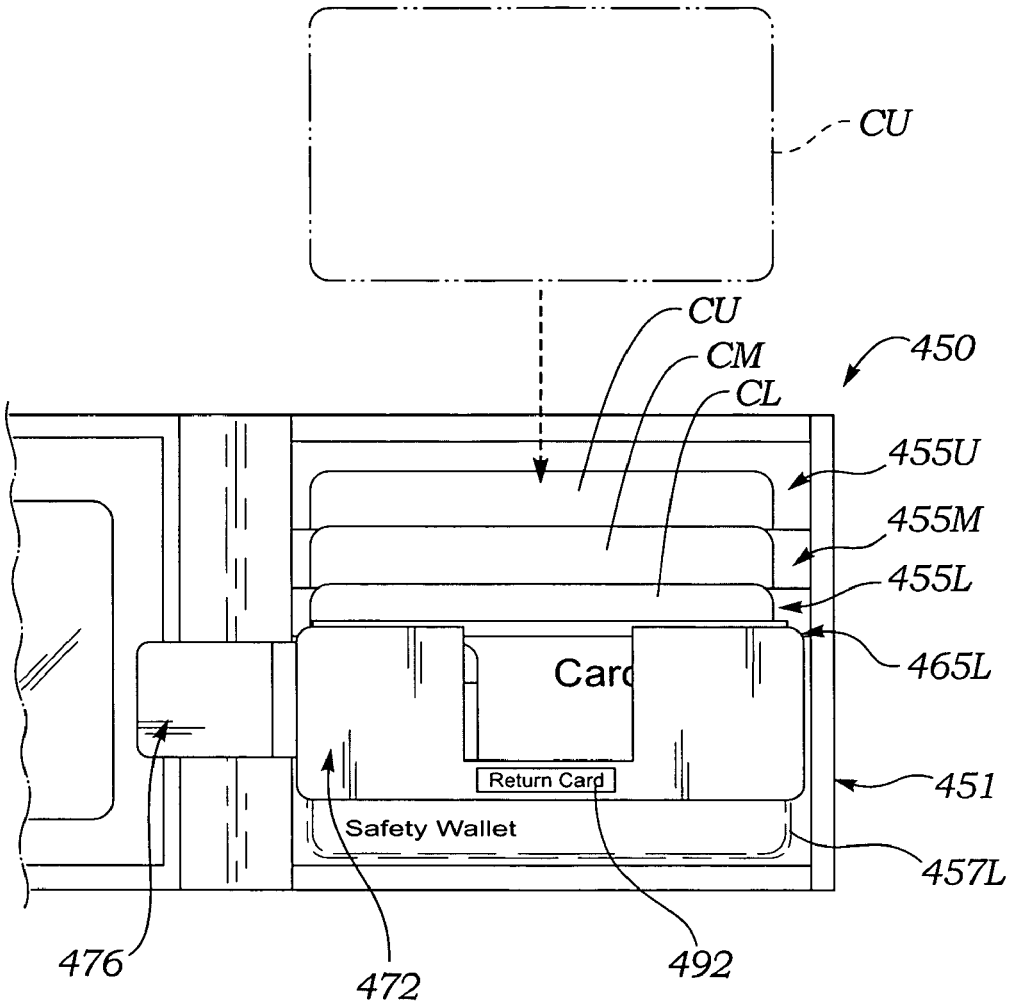
FIG. 24 is a view similar to FIG. 23, showing a cover panel thereof pivoted 180 degrees forward and downward from an upright orientation to enable a credit card to be removed from the wallet.

FIGS. 22-24 illustrate a fifth embodiment 450 of a security wallet insert for holding credit cards according to the present invention. Insert 450 includes a generally rectangularly-shaped base panel 451 which is similar in construction and function to base panels 50, 150, 250, and 350 described above, and which is provided with one of the previously described structures for attaching the insert to a wallet, such as wallet A shown in FIGS. 22-24.

As may be seen best by referring to FIG. 24, insert 450 has a plurality of vertically staggered credit card compartments, e.g., upper, middle and lower compartments 455U. 455M, 455L. Outermost, lower credit card compartment 455L has a laterally elongated, rectangular shape including a laterally disposed upper opening or mouth 465L. As shown in FIG. 24, mouth 465L of lower credit card compartment 455U receives downwardly therein left and right lower mounting tabs 473L, 473R of a laterally elongated rectangularly-shaped cover plate 472. Mounting tabs 473L, 473R are made of a thin, rigid material such as vinyl and are fastened to an inner wall surface 458 of front lower cover panel 457, and are joined to a lower edge 459 of cover panel 472 by flexible hinges 474L, 474R. As may be understood by referring to FIGS. 23 and 24, cover plate 472 is pivotable from an upper, closed position covering credit card compartments 453, as shown in FIG. 23, to a lower, open access position, as shown in FIG. 24 along a laterally disposed pivot axis through hinges 474L, 474R.

Referring to FIGS. 22 and 23, it may be seen that insert 450 includes a blocking arm support base plate 475, made of a relatively rigid material such as a thin metal or hard plastic. Blocking arm support plate 475 has a generally rectangular shape, and is fastened to the upper left-hand corner of front wall panel 457L of lower pocket 455L.

Referring to FIG. 22, it may be seen that insert 450 includes a thin, vertically elongated rectangularly-shaped blocking arm 476 which is pivotably mounted to blocking arm support plate 475 at a laterally centrally located, lower portion of the blocking arm by a pivot joint 481. Pivot joint 481 includes a circular perforation 482 which is disposed through the thickness dimension of the blocking arm 476. Pivot joint 481 also includes a thin, circular cross-section pivot boss 483 which protrudes outwardly forwards from an outer surface 484 of blocking arm support plate 475 and through perforation 482 through blocking arm 512.

Blocking arm 476 is pivotably retained on pivot boss 483 by a thin, circular cross-section retainer disk 485 which is fastened to front outer surface 486 of pivot boss 483, the retainer disk having a larger diameter than perforation 482 through blocking arm 476. The above-described construction of pivot joint 481 disposed between blocking arm 476 and blocking arm support plate 475 enables the blocking arm to be pivoted counterclockwise from a vertical closed position, which prevents cover plate 472 from being pivoted downwardly and forwardly to permit access to credit cards in compartments 455, as shown in FIG. 22, to a horizontal unblocking position, as shown in FIGS. 23 and 24.

Counterclockwise pivotal motion of blocking arm 476 is limited to a maximum excursion of ninety degrees by a first, rectangularly-shaped opening abutment stop 487. Opening abutment stop 487 is made of a thin sheet of rigid material such as metal or plastic which has a horizontally disposed upper edge wall 488 that abuts the left-hand edge wall 489 of blocking arm 476, when the blocking arm is pivoted ninety degrees counterclockwise from a blocking position, as shown in FIG. 22, to an unblocking access position, as shown in FIGS. 23 and 24.

With blocking arm 476 pivoted counterclockwise to an unblocking position, as shown in FIG. 23, cover plate 472 is pivotable vertically downwards to allow access to credit cards in compartments 455, as shown in FIG. 24.

A "RETURN CARD" message 492 is printed on front surface 457L of lower credit compartment 455L, and is viewable only when the cover panel is pivoted downwards to an opened, access position, thus informing a user that credit cards should be returned to credit card compartments, before pivoting cover panel 472 to an upward, closed position. Upward orientation of cover panel 472 is required to enable blocking arm 476 to be pivoted clockwise to a closed position, which in turn enables wallet A to be closed.

Clockwise closing pivotal motion of blocking arm 476 relative to blocking arm support plate 475 is limited to a maximum excursion of ninety degrees. This limitation is accomplished by a second, rectangular cross-section closing abutment stop 497 which protrudes from an upper right-hand corner of base plate 475. Closing abutment stop 497 is of similar construction to opening abutment stop 487, and has a vertically disposed left-hand edge 498 which abuts the right-hand edge wall 499 of blocking arm 476, when the blocking arm is pivoted ninety degrees clockwise from an unblocking position as shown in FIGS. 23 and 24, to a blocking position, as shown in FIG. 22.

As shown in FIG. 23, insert 450 optionally is provided with a releasable fastener to maintain cover panel 472 in an open position and blocking arm 476 in an outwardly extending position. Thus, as shown in FIG. 23 insert 450 optionally includes a first fastener element 478 attached to cover panel 472, such as a fabric hook fastener strip, fastened to the front surface of the cover panel and a second fastener element 479 attached to credit card compartment 453, such as a fabric eye fastener strip fastened to the front surface of pivot boss retainer disk 485.

Figure 26:
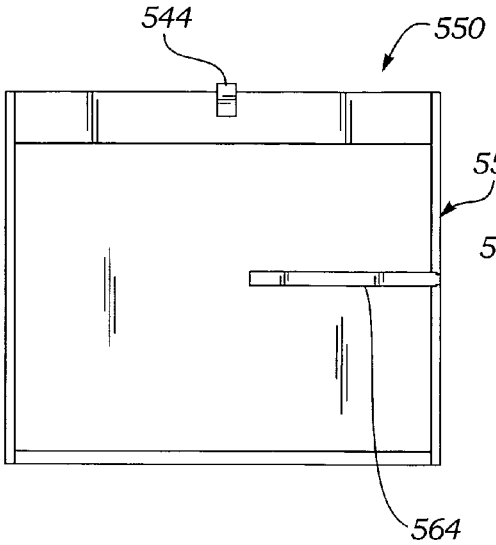
FIG. 26 is a rear elevation view of the insert of FIG. 25.
Figure 25:
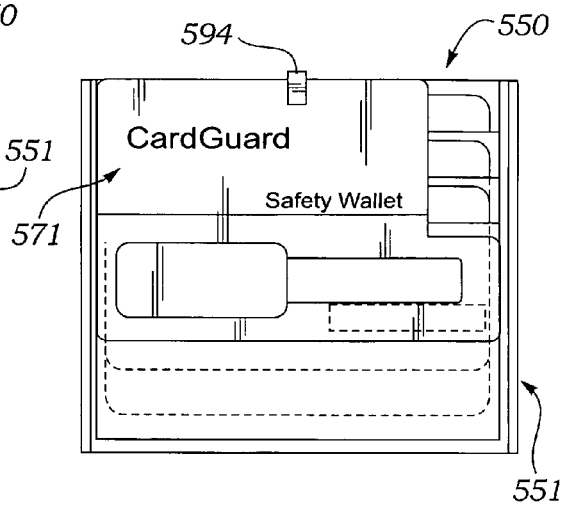
FIG. 25 is a front elevation view of a sixth, money clip type embodiment of a security wallet insert for credit cards according to the present invention.
Figure 27:
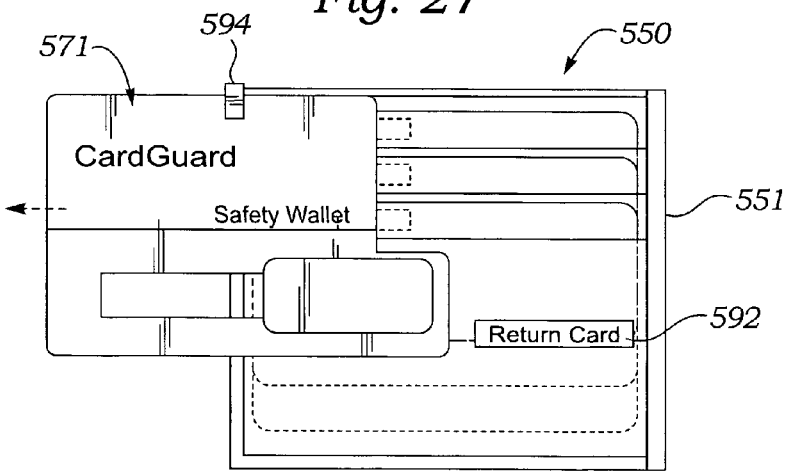
FIG. 27 is a front elevation view of the insert of FIGS. 25 and 26, showing a cover panel thereof slid to the left to enable removal of a credit card from the insert.

FIGS. 25-27 illustrate a sixth embodiment 550 of a security wallet insert according to the present invention. Embodiment 550 is adapted for use as a self-contained, money-clip type credit card holder which is useable without a wallet.

As shown in FIGS. 25-27, insert 550 is substantially similar in structure and function to basic embodiment 50, described above. However, as shown in FIG. 26, U-shaped spring clip 114 of insert 50 (see FIG. 2) is replaced by a thin, metal hairpin type clip 564 which is attached to base panel 551 and adapted to secure the insert to a belt or pocket of a user.

Figure 28:
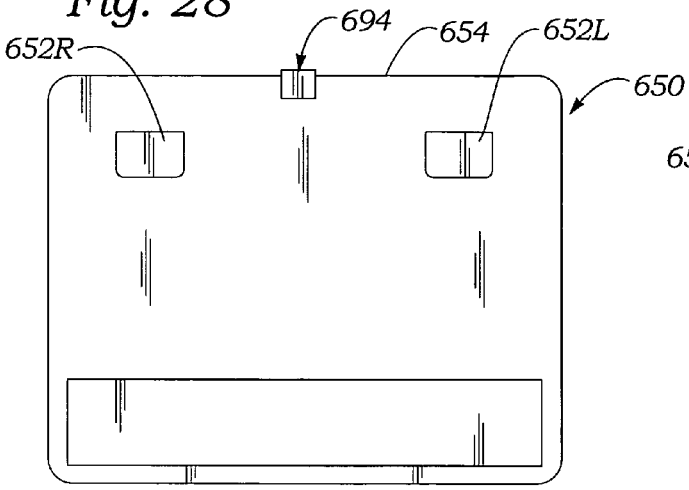
FIG. 28 is a rear elevation view of a seventh embodiment of a security wallet insert for credit cards according to the present invention.
Figure 29:
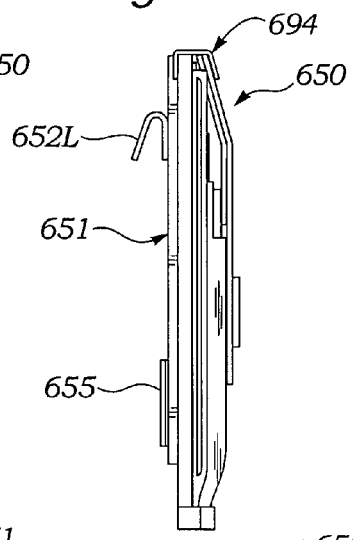
FIG. 29 is a left side elevation view of the wallet insert of FIG. 28.
Figure 30:
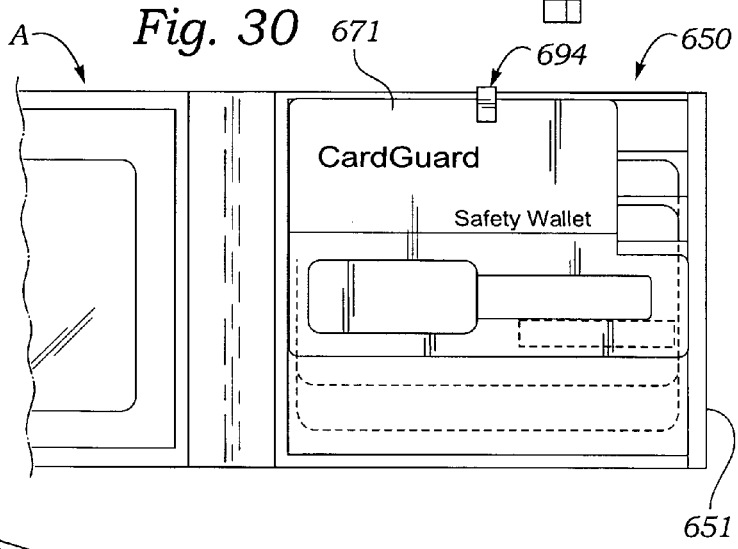
FIG. 30 is a front elevation view of the wallet insert of FIGS. 28 and 29, showing the insert installed in a wallet.
Figure 31:
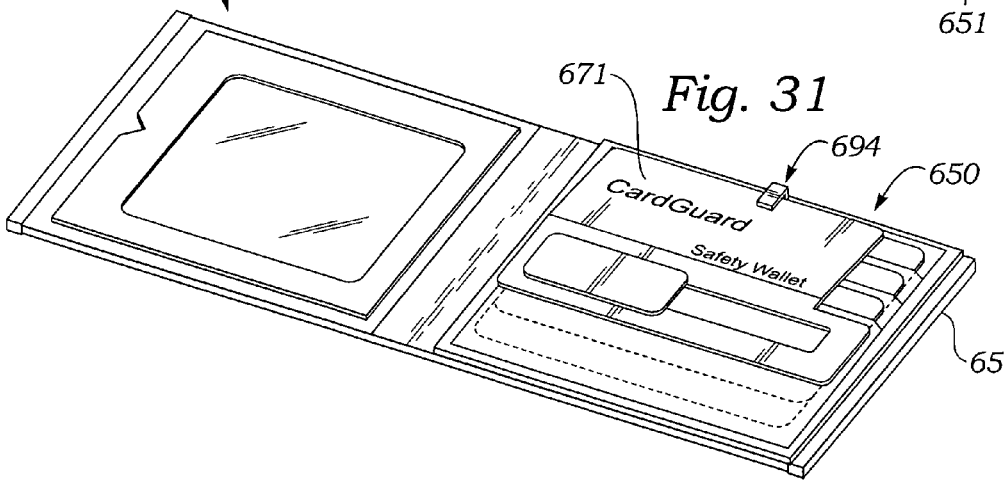
FIG. 31 is a perspective view of the wallet and insert of FIG. 30.

FIGS. 28-31 illustrate a seventh embodiment 650 of security wallet insert for credit cards according to the present invention. Embodiment 650 is substantially similar in structure and function to the basic embodiment 50 described above, but includes different attachment means for attaching the insert to a wallet. Thus, as shown in FIGS. 28 and 29, insert 650 includes a pair of inverted U-shaped hanger hooks 652L, 652R attached to rear surface 653 of base panel 651 of the insert. Hooks 652L, 652R are located near the upper horizontal edge 654 of base panel 651. Optionally, hooks 652L, 652R may be replaced by adhesive pads. Preferably, as shown in FIG. 28, insert 650 includes a laterally elongated rectangular strip of double-stick, pressure sensitive adhesive 655 to further secure base panel 651 of the insert to the front pocket wall of a wallet A.

What is claimed is:

1. A credit card carrying case comprising;

a. a rectangularly-shaped base plate, b. a credit card compartment attached to said base plate, said credit card compartment having at least one pocket adapted to hold therein a thin, flat, rectangularly-shaped credit card, said pocket having a laterally disposed bottom edge, laterally opposed, vertically disposed side edges, and a laterally disposed upper opening through which a credit card is insertable into and removable from said pocket, c. a movable cover panel movable from a first, closed position overlying at least a portion of said pocket opening to thereby prevent transit of a credit card through said pocket opening, to a second, opened position permitting said transit, said cover panel extending in said open position a greater distance from said base plate than in said closed position, thereby requiring a larger storage space for said case with said cover panel in said open position, said cover panel being slidably mounted by a slide joint to at least one of said base plate and said credit card compartment, said slide joint enabling lateral translational uncovering motion of said cover panel relative to said pocket opening, said lateral translational uncovering motion of said cover panel relative to said pocket opening moving an obstructing portion of said cover panel from a closed position at least partially overlying said pocket opening to an open position displaced from said pocket opening, said obstructing portion of said cover panel including a hanger bracket which projects from an edge of said cover panel, said hanger bracket slidably engaging said base plate, and d. a locking mechanism for locking said cover panel in an outwardly extended open position upon removal of a credit card from said pocket, said locking mechanism comprising in combination;

i. a locking tab depressable rearwardly to a position substantially flush with a rear wall surface of said pocket when a credit card is present in said pocket, said tab protruding forwardly of said rear wall surface when a credit card is not present in said pocket, and ii. an abutting surface fixed with respect to said cover panel, said abutting surface being effective in abutting said tab which protrudes outwardly of said rear wall surface when said pocket is not occupied by a credit card, when an effort is made to move said cover panel to a closed position overlying said pocket.

2. The credit card carrying case of claim 1 wherein said abutting surface is further defined as being a vertically disposed edge wall of a tab catch bar which protrudes rearwardly from a rear surface of said cover panel confronting a front surface of said pocket.

3. The credit card carrying case of claim 1 wherein said abutting surface is further defined as being that of an edge wall of said cover panel.

4. The credit card carrying case of claim 1 wherein said locking tab is further defined as being resiliently biased to protrude forwardly of said rear wall surface of said credit card pocket, when said pocket is not occupied by a credit card.

5. The credit card carrying case of claim 4 wherein said locking tab is further defined as including a leaf spring.

6. The credit card carrying case of claim 1 further including a fastener for attaching said case to a wallet.

7. The credit card carrying case of claim 6 wherein said fastener is further defined as comprising at least a first flexible, flat spring clip fastened to said base plate and adapted to exert a compressive force on a part of a wallet positioned between said spring clip and said base plate.

8. The credit card carrying case of claim 6 wherein said fastener is further defined as including at least one pressure sensitive adhesive strip adapted to adhere to confronting flat surfaces of said case and a wallet.

9. The credit card carrying case of claim 6 wherein said fastener is further defined as being a tongue which protrudes from said base plate, said tongue being adapted to insertable retention within an opening between parts of a wallet.

10. The credit card carrying case of claim 9 wherein said tongue is further defined as protruding outwardly of a perimeter of said base plate.

11. The credit card carrying case of claim 9 wherein said tongue is further defined as protruding rearwardly of rear surface of said base plate.

12. The credit card carrying case of claim 11 wherein said tongue is further defined as being hingedly joined to said base plate.

13. The credit card carrying case of claim 1 further including a wallet fastened thereto.

* * * * *